US006329749B1

(12) United States Patent
Mori et al.

(10) Patent No.: US 6,329,749 B1
(45) Date of Patent: Dec. 11, 2001

(54) PLANAR TYPE PLASMA DISCHARGE DISPLAY DEVICE

(75) Inventors: Hiroshi Mori; Suehiro Nakamura, both of Kanagawa (JP)

(73) Assignee: Sony Corporation (JP)

( * ) Notice: Subject to any disclaimer, the term of this patent is extended or adjusted under 35 U.S.C. 154(b) by 0 days.

(21) Appl. No.: 09/240,633

(22) Filed: Feb. 1, 1999

(30) Foreign Application Priority Data

Feb. 16, 1998 (JP) ..... 10-032981
Mar. 11, 1998 (JP) ..... 10-059767

(51) Int. Cl.[7] ..... G09G 3/10

(52) U.S. Cl. ..... 313/491; 313/494; 315/169.4; 315/169.1

(58) Field of Search ..... 313/494, 491, 313/500, 506, 509, 582–584; 315/169.4, 169.1, 169.2

(56) References Cited

U.S. PATENT DOCUMENTS

| | | | |
|---|---|---|---|
| 3,944,874 | 3/1976 | Murley, Jr. | 315/169 TV |
| 5,317,231 | 5/1994 | Lee . | |
| 5,471,112 | 11/1995 | Hamon et al. . | |
| 5,561,348 * | 10/1996 | Schoenbach et al. | 315/169.1 |
| 6,140,774 * | 10/2000 | Mori et al. | 315/169.4 |

FOREIGN PATENT DOCUMENTS

| | | |
|---|---|---|
| 59146026 | 6/1984 | (EP) . |
| 0 649 159 A1 | 4/1995 | (EP) . |
| 2 668 844 | 5/1992 | (FR) . |
| 57162244 | 10/1982 | (JP) . |
| 59040439 | 3/1984 | (JP) . |
| 08115675 | 5/1996 | (JP) . |
| 98/39763 | 9/1998 | (WO) . |

OTHER PUBLICATIONS

Recent Newspaper Production Major Equipments—1986, issued by Japanese Newspaper Association.

* cited by examiner

*Primary Examiner*—Richard A. Rosenberger
*Assistant Examiner*—Layla Lauchman
(74) *Attorney, Agent, or Firm*—Ronald P. Kananen; Rader, Fishman & Grauer PLLC

(57) ABSTRACT

In a planar type plasma discharge display device including first and second electrode groups to display a desired image by plasma discharge produced between the first and second electrode groups, its accuracy may be increased, and its manufacturing may be simplified. A pair of discharge electrode groups comprising a first electrode group and a second electrode group, each formed by arraying a plurality of electrode elements, are arrayed on a common substrate in a two-dimensional fashion. Then, a desired image is displayed by plasma discharge produced between selected electrode elements of the first and second electrode groups. To solve a problem of an ordinary matrix type high-definition display device which is not reliable because an area of a terminal disposed portion is increased by the enormous number of terminals concerning the horizontal direction scanning, a terminal width is reduced or terminals are disposed very close to each other. The display device includes first and second electrode groups. The first electrode group is formed by arraying a plurality of electrode elements X extended in a first direction, and the second electrode group is formed by arraying a plurality of electrode elements Y extended in the direction crossing the first direction. The electrode element Y of the second electrode group forms adjacent four electrode elements into one set, a common terminal is led out from every other electrode elements in each set, and a plasma discharge portion is formed at a portion in which every other electrode elements X of the first electrode groups and corresponding adjacent two electrode elements in each set of the second electrode group cross to each other.

23 Claims, 22 Drawing Sheets

PLANAR TYPE PLASMA DISCHARGE DISPLAY DEVICE

FIELD OF THE INVENTION

The present invention relates to a planar type plasma discharge display device or a so-called two-electrode system planar type plasma discharge display device including first and second electrode groups to display a desired image by plasma discharge produced between predetermined electrodes of the two electrode groups.

DESCRIPTION OF THE RELATED ART

In general, as a planar type plasma discharge display device of a two-electrode system matrix display mode including first and second electrode groups in which a plurality of electrode elements called X electrodes and Y electrodes are arrayed to display a desired image by plasma discharge produced between selected electrodes of the two electrode groups, there is known a plasma panel which is disclosed in Japanese laid-open patent application No. 6-52802.

In this kind of planar type plasma discharge display device, a front plate and a back plate are sealed in an opposing relation so as to form a gas space between the front plate and the back plate.

A first electrode group and a light-emitting material, for example, are formed on the front plate side, and a second electrode group is formed on the back plate. The first and second electrode groups are formed of parallel electrodes, i.e. column electrodes and row electrodes in which a plurality of electrodes are arrayed with a predetermined interval in parallel to each other. Then, in the front plate, a light-emitting material is coated on both sides of each electrode of the first electrode group.

The parallel electrodes of the first and second electrode groups are made perpendicular to each other.

As described above, in the ordinary planar type plasma discharge display device, the first and second electrode groups are formed on the front plate and the back plate which are disposed in an opposing relation to each other, i.e. different plates. Accordingly, an accuracy at which a mutual positional relationship between the first and second electrode groups is set depends upon an accuracy at which each electrode group is formed on each plate and a mutual positional relationship required when the front plate and the back plate are bonded and sealed. There are then the problems that a high accuracy is difficult to obtain when a uniform interval is set and a positional relationship is set in each portion and that the planar type plasma discharge display device should be assembled with a special care.

Also, in this case, on the same plate, there is formed one electrode pattern, e.g. Y electrode on which there is formed a dielectric layer on which a fluorescent material is formed. In this case, to avoid the fluorescent material from being damaged by plasma, the fluorescent material is coated except the upper portion of Y electrode. Therefore, according to this arrangement, the coated area of the fluorescent material is small, and there is then the problem that it is difficult to display an image with a high light-emission brightness.

Further, when a color image is displayed according to this arrangement, since a work for coating a fluorescent pattern of each color is cumbersome, if the electrode pattern and the fluorescent pattern are formed on the same plate, there is then the problem that a work efficiency and a yield are lowered.

In a plasma discharge display device of a two-electrode system, i.e. so-called X–Y simple matrix system, as the number of pixels increases as the display device becomes increasingly high-definition, the number of electrodes, accordingly, the number of electrode terminals increases.

Then, if the number of electrode terminals increases as described above, there is then the problem that a reliability of the display device is lowered in accordance with the increase of the area of the portion in which these terminals are disposed or the reduction of the terminal width or when the terminals are disposed close to each other or the like.

In general, the number of pixels in the horizontal (row) direction is considerably large as compared with the number of pixels in the vertical (column) direction. Accordingly, in the case of the display device of the above-mentioned simple matrix system, the number of electrodes (hereinafter referred to as column electrodes or Y electrodes) extended along the vertical direction is considerably larger than the number of electrodes (hereinafter referred to as row electrodes or X electrodes) extended along the horizontal direction. That is, the number of electrode terminals concerning the scanning in the horizontal direction is considerably large as compared with the number of electrode terminals concerning the scanning in the vertical direction.

According to a monochromatic display device, for example, in a VGA (Video Graphic Array) display, while the number of row electrodes extended in the row direction is 480, the number of column electrodes extended in the column direction is 640.

Also, in a SVGA (Super Video Graphic Array) display, while the number of row electrodes extended in the row direction is 600, the number of column electrodes extended in the column direction is 800.

Then, in an XGA (Extended Graphic Array) display, while the number of row electrodes extended in the row direction is 768, the number of column electrodes extended in the column direction is 1024.

Also, in an SXGA (Super Extended Graphic Array) display, while the number of row electrodes extended in the row direction is 1024, the number of column electrodes extended in the column direction is 1280.

Also, in a UXGA (Ultra Extended Graphic Array) display, while the number of row electrodes extended in the row direction is 1200, the number of column electrodes extended in the column direction is 1600.

Then, in these array display methods, when a color image is displayed, a unit light-emission portion is composed of red, green and blue light-emission portions with the result that the number of column electrodes is multiplied by three in each method.

As described above, since the number of terminals concerning the scanning in the horizontal direction, i.e. the number of the terminals of the above-mentioned column electrodes in the high-definition type display device of an ordinary so-called matrix system is enormous, a reliability of the display device is lowered in accordance with the increase of the area of the portion in which the terminals of the column electrodes or the reduction of the terminal width or when the terminals are disposed close to each other.

SUMMARY OF THE INVENTION

An object of the present invention is to provide a planar type plasma discharge display device including first and second electrode groups to display a desired image by plasma discharge produced between the first and second electrode groups with increased brightness and accuracy that can be easily manufactured.

Another object of the present invention is to solve the aforementioned problems.

That is, having noted that the number of the terminals of the column electrodes is considerably large as compared with the number of the terminals of the row electrodes in the ordinary display device, the number of terminals of the electrodes may be decreased by increasing the number of terminals of the row electrodes so that the number of terminals of both electrodes may be well-balanced, thereby making it possible to alleviate the dense column electrode terminals.

According to an aspect of the present invention, there is provided a planar type plasma discharge display device, in which a first electrode group and a second electrode group, each being composed of a plurality of electrode elements, are arrayed on a common substrate in a two-dimensional fashion. Then, a desired image is displayed by plasma discharge produced between predetermined electrode elements of the first and second electrode groups.

Also, in a planar type plasma discharge display device according to the present invention, a first electrode group and a second electrode group, each being composed of a plurality of electrode elements, are arrayed on a common substrate in a two-dimensional fashion, the electrode elements of the first electrode group are composed of a plurality of parallel electrode elements extended along a first direction and which are arrayed with a predetermined interval in parallel to each other, and the electrode elements of the second electrode groups are composed of parallel electrode elements extended along a second direction crossing the first direction and which are arrayed with a predetermined interval in parallel to each other. Insulating layers are interposed at portions in which the electrode elements of the first and second electrode groups cross to each other, whereby the electrode elements are electrically insulated from each other.

Then, a discharge electrode segment is formed on at least one electrode element of the first or second electrode group in response to the crossing portion of the electrode elements of the first and second electrode groups. A plasma discharge segment is formed between the discharge electrode segment and the discharge electrode segment of other electrode group or electrode element.

That is, according to the present invention, on the basis of the fact that a plasma discharge for displaying an image may be reliably produced by selecting the electrode layout, the applied voltage or the like even when a so-called pair of discharge electrode groups composed of the first and second electrode groups are arrayed in a two-dimensional fashion, the pair of discharge electrode groups are arrayed on the common substrate.

That is, according to the present invention, the pair of discharge electrode groups are arrayed on the common substrate in a two-dimensional fashion. A plasma discharge is produced with application of a predetermined discharge voltage between the electrodes, and a desired image is displayed by a discharge gas light-emission caused by this plasma discharge or a light produced by this discharge, e.g. light emitted from a fluorescent material excited by ultraviolet rays.

According to another aspect of the present invention, there is provided a plasma display device which comprises a first electrode group and a second electrode group.

The first electrode group is formed by arraying a plurality of electrode elements extended in a first direction.

The second electrode group is formed by arraying a plurality of electrode elements extended in a direction crossing the first direction.

The electrode elements of the second electrode group form adjacent four electrode elements into a set, and a common terminal is led out from every other electrode elements in each set.

On the other hand, a plasma discharge portion is formed in response to a portion in which every other electrode elements of the first electrode group and corresponding adjacent two electrode elements in each set of the second electrode group cross each other.

The first and second electrode groups are formed on first and second substrates opposing to each other or disposed on a common substrate in a two-dimensional fashion.

Then, plasma discharge is produced by applying a predetermined discharge voltage to a space formed between the electrode elements of the first and second electrode groups in a predetermined plasma discharge portion. By this plasma discharge, an image is displayed by a discharge gas light emission or an image is displayed by light produced by this discharge, e.g. by light emitted from a fluorescent material excited by ultraviolet rays.

DESCRIPTION OF THE PREFERRED EMBODIMENTS

Figure 1:
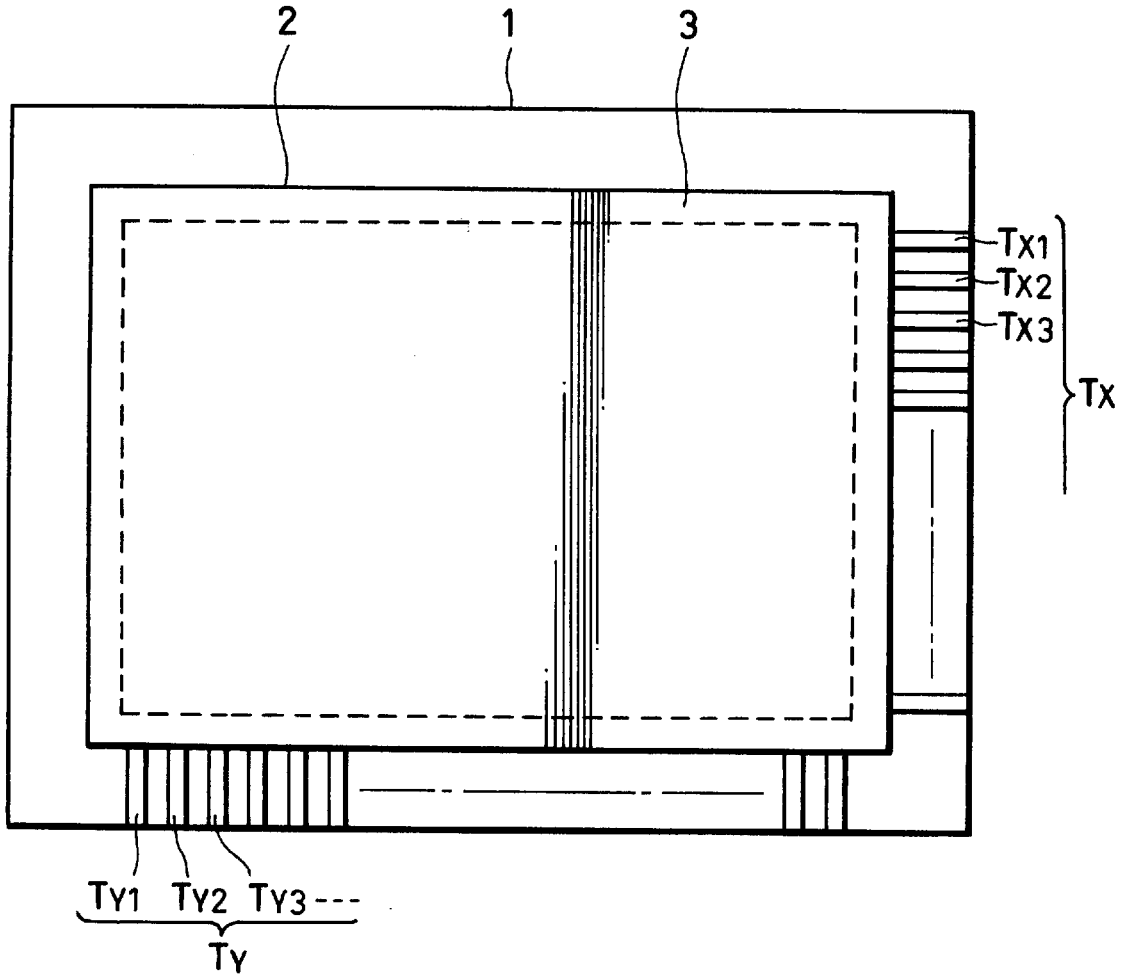
FIG. 1 is a plan view of a planar type plasma discharge display device according to an embodiment of the present invention.

In a fundamental arrangement of a planar type plasma discharge display device according to the present invention, a pair of discharge electrode groups comprising first and second electrode groups, each being composed of a plurality of electrode elements, are arrayed on a common substrate in a two-dimensional fashion. A desired image is displayed by plasma discharge sequentially or simultaneously produced between desired, e.g. selected electrode elements of the first and second electrode groups.

This discharge may be generated by application of an AC or DC voltage.

The first and second electrode groups are comprised of electrode elements (referred to as row electrode elements and column electrode elements) based on a plurality of parallel electrode arrangements extended in the directions crossing to each other, e.g. perpendicular first direction (referred to as row direction) and second direction (referred to as column direction) and which are arrayed with a predetermined interval.

Insulating layers are interposed at a portion in which the electrode elements of the first and second electrode groups cross to each other to thereby electrically insulate the electrode elements of the first and second electrode groups.

Then, a discharge electrode segment is formed on at least one electrode element of the first or second electrode group in response to the crossing portion of the electrode elements of the first and second electrode groups. A plasma discharge segment is formed between this discharge electrode segment and a discharge electrode segment or electrode element of other electrode group. An interval between the discharge electrode segments for forming these plasma discharge segments or an interval between the discharge electrode segment and the electrode element is selected to be a narrow interval d which enables plasma discharge to be generated with application of a predetermined discharge start voltage. An interval D between the electrode elements of the adjacent first and second electrode groups wherein plasma discharge should be avoided although a similar voltage is applied is selected to be larger than the above-mentioned interval d.

The electrode element of the first electrode group and the discharge electrode segment of the electrode element of the second electrode group may be formed of the same conductive layer. That is, the electrode element of the first electrode group and the discharge electrode segment of the second electrode element may be formed of the same conductive layer with the same process. In this case, the above-mentioned interval d may be set accurately. However, these may be formed of conductive layers with different processes.

Also, a planar type plasma discharge display device according to the present invention includes a planar display receptacle in which first and second substrates are opposed with a predetermined interval and peripheral portions of the first and second substrates are sealed airtight, e.g. sealed by glass frit to form a flat gas space.

At least one of the first and second substrates is formed of a transparent substrate capable of passing display light therethrough. The first and second substrates may be formed of glass substrates, respectively, for example.

Then, the first substrate is used as a common substrate, and first and second electrode groups are formed on this common substrate.

However, while the first substrate itself is not limited to the common substrate on which the first and second electrode groups are formed as described above, other substrate on which the first and second electrode groups are formed may be disposed on the first substrate in an abutting fashion.

Then, a fluorescent layer, e.g. a fluorescent surface in which fluorescent materials R, G and B for emitting light of red, green and blue is formed on the second substrate when a color image is displayed. When an image of a single color is displayed, a fluorescent surface of a single color is formed on the second substrate.

A band-shaped partition is protrusively formed on the second substrate on which this fluorescent layer is formed, so as to oppose the electrode portion extended in the second direction of the electrode element of the second electrode group along the same, i.e. along the column direction. This partition is adapted to block a cross-talk produced between respective unit discharge regions.

Also, when this planar type plasma discharge display device is driven by an AC voltage, a dielectric layer is formed over the portions in which at least the first and second electrode groups are formed.

On the dielectric layer, there may be formed a surface layer having a work function smaller than that of this dielectric layer and which has a surface protection effect capable of protecting the surface of the dielectric layer from being damaged by plasma discharge, if necessary.

A planar type plasma display device according to the present invention will be described with reference to the drawings. The device according to the present invention, however, is not limited to the arrangement of these examples.

Figure 2:
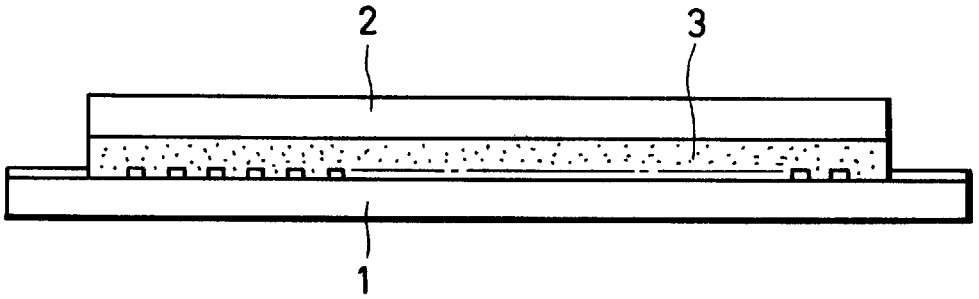
FIG. 2 is a side view of a planar type plasma discharge display device according to the embodiment of the present invention.

In each example, the planar type plasma display device is of the AC drive type. As shown by a plan view of FIG. 1 and by a side view of FIG. 2, there is formed a planar display receptacle in which a first substrate 1 and a second substrate 2 at least one of which is made of a transparent glass substrate capable of passing display light therethrough, are opposed with a predetermined interval, the peripheral portions of the first and second substrates are sealed airtight by a seal material 3 such as glass frit or the like and a flat gas space is formed between the two substrates 1 and 2.

The first substrate 1 has an area larger than that of the second substrate 2, and its side edge portions, i.e. four side edge portions in the illustrated example are outwardly exposed from the respective side edge portions of the second substrate 2.

Figure 3:
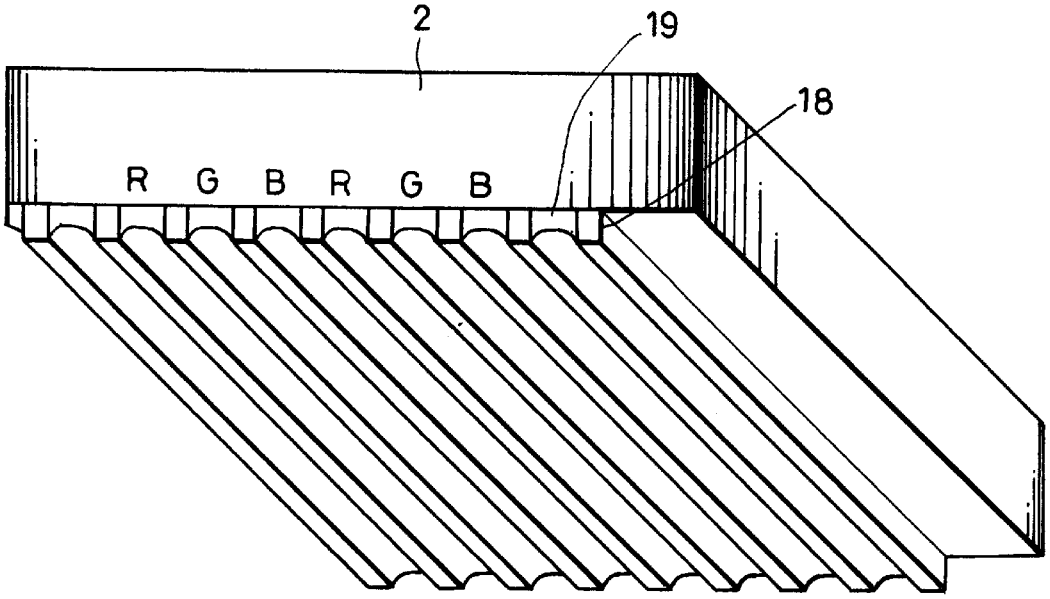
FIG. 3 is a fragmentary cross-sectional perspective view and side view of a planar type plasma discharge display device according to an embodiment of the present invention.
Figure 3:
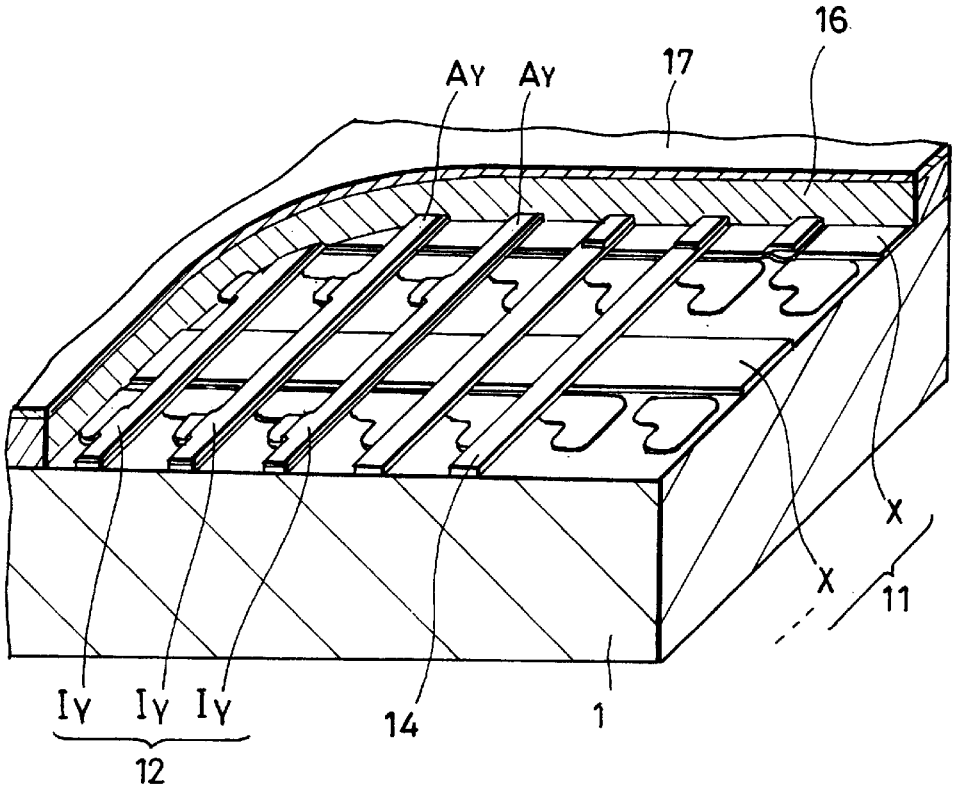

FIG. 3 is a perspective view showing a main portion thereof with the inside being disclosed by disassembling the first and second substrates 1 and 2.

A first electrode group 11 in which a plurality of row electrode elements X are arrayed and a second electrode group 12 in which a plurality of column electrode elements Y are arrayed are formed on the inner surface of the first substrate 1, i.e. the surface opposing the second substrate 2.

Figure 4A:
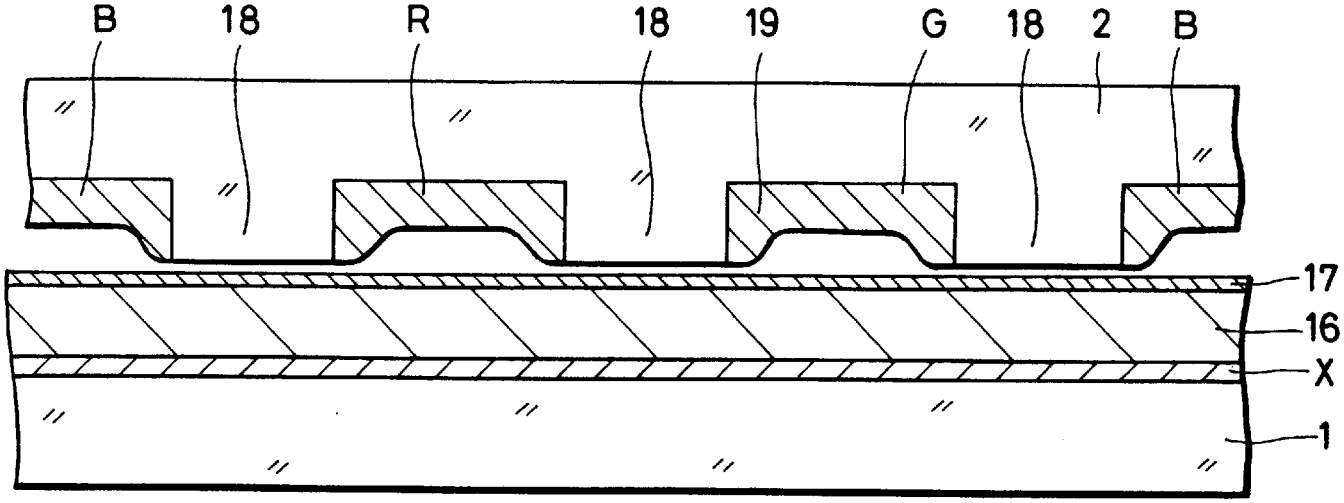
FIG. 4A is a fragmentary cross-sectional view of a planar plasma discharge display device according to the embodiment of the present invention.
Figure 4B:
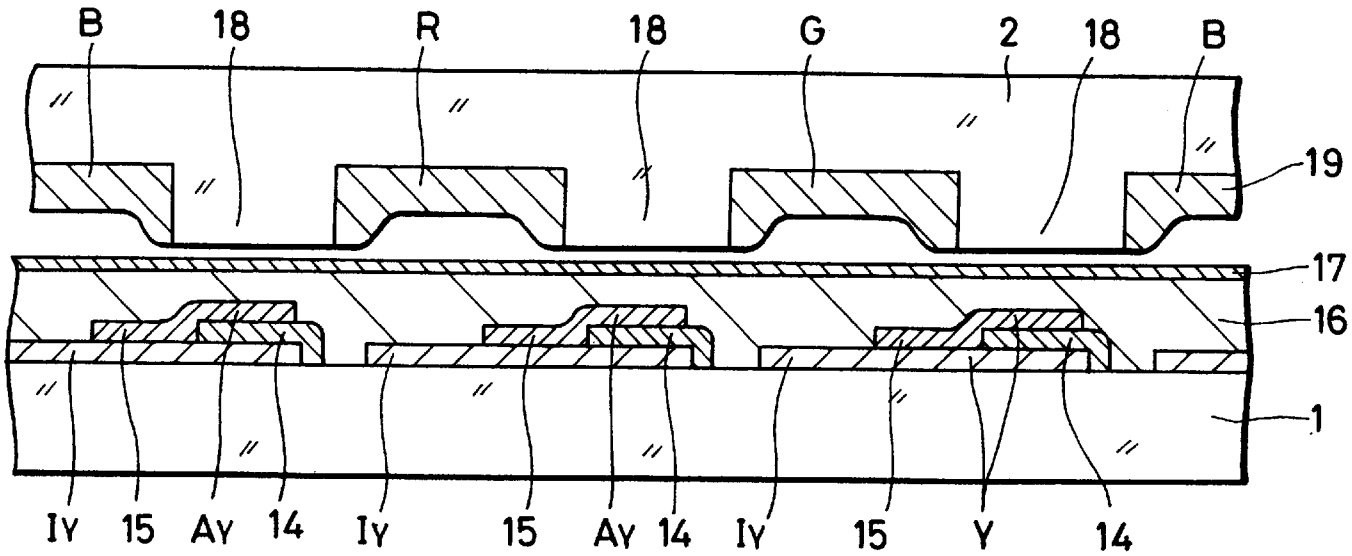
FIG. 4B is a fragmentary cross-sectional view taken along other surface of the planar type plasma discharge display device according to the embodiment of the present invention.
Figure 5:
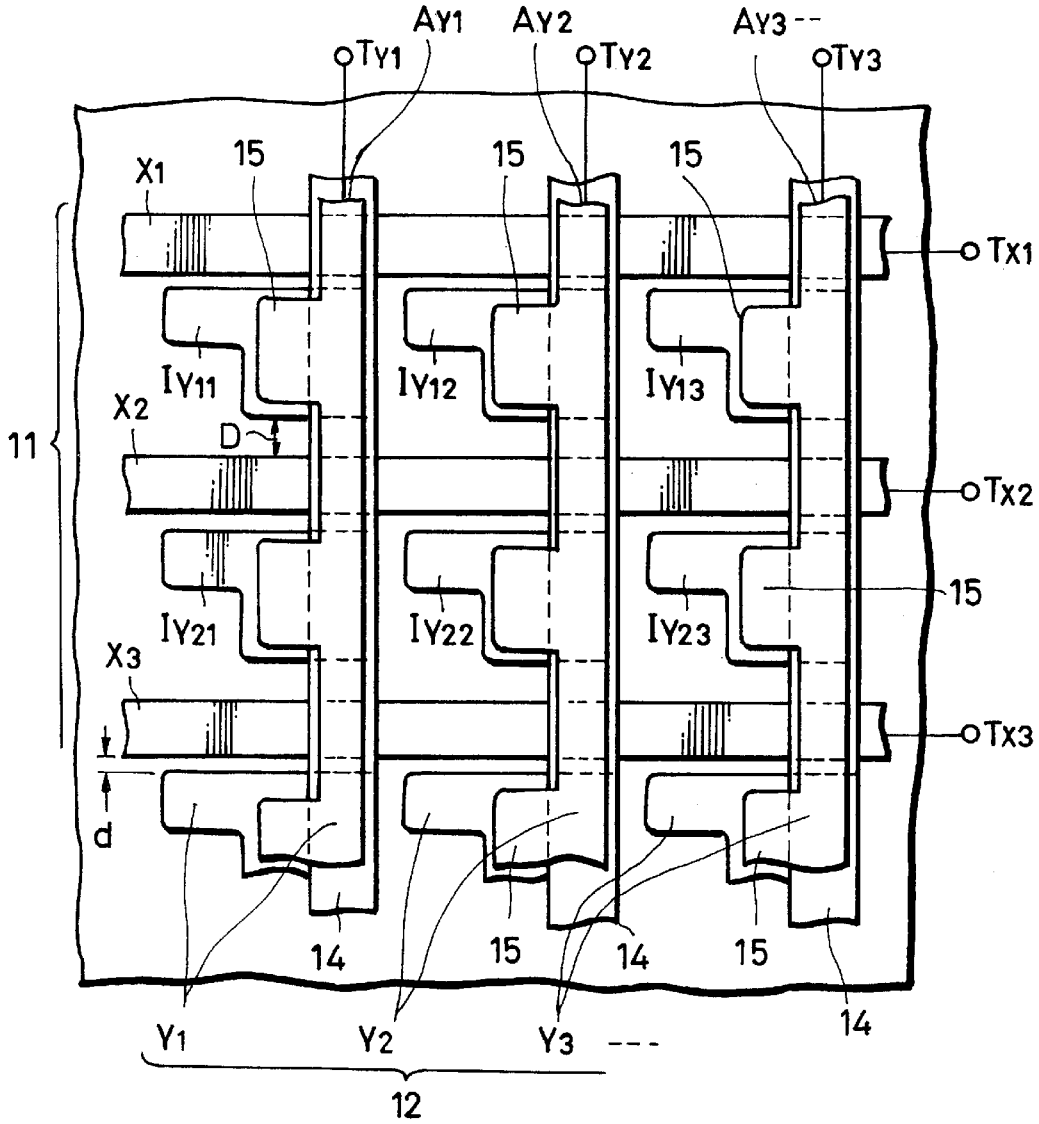
FIG. 5 is a pattern diagram of the example of the device according to the present invention.

FIG. 4A shows a cross-sectional view taken along the row direction of the row electrode element X of an example of the above-mentioned device according to the present invention. FIG. 4B shows a cross-sectional view taken along the similar row direction between the row electrode elements X. FIG. 5 shows a pattern diagram of an example of the first and second electrode groups 11 and 12 formed on the first substrate 1.

In this example, the first electrode group 11 is formed in such a manner that a plurality of row electrode elements $X_1$, $X_2$, $X_3$, . . . of band-shaped parallel electrode arrangement extended along the row direction with a predetermined interval are arrayed in a two-dimensional fashion as shown in FIG. 5.

These row electrode elements X ($X_1$, $X_2$, $X_3$ . . . ) may form respective row electrode terminals Tx ($T_{x1}$, $T_{x2}$, $T_{x3}$ . . . ) by extending respective end portions thereof to the side edge portion of the first substrate 1 until they are exposed to the outside.

Also, the second electrode group 12 in this example comprises band-like electrode portions $A_Y$ ($A_{Y1}$, $A_{Y2}$, $A_{Y3}$ . . . ) extended along the column direction and discharge electrode segments $I_Y$, similarly as shown in FIG. 5.

A band-like insulating layer 14 made of $SiO_2$ or the like is deposited on the lower surface of each band-like electrode segment AY in the column direction across the row electrode element X, thereby electrically insulating each band-like electrode segment and each row electrode element X from each other.

Also, these electrode segments AY may form respective row electrode terminals $T_Y$ ($T_{Y1}$, $T_{Y2}$, $T_{Y3}$ . . . ) by extending respective end portions thereof, for example, to the side edge portion of the first substrate 1 until they are exposed to the outside.

The discharge electrode portion IY comprises electrode segments $I_{Y11}$, $I_{Y12}$, $I_{Y13}$ . . . , $I_{Y21}$, $I_{Y22}$, $I_{Y23}$ . . . , $I_{Y31}$, $I_{Y32}$, $I_{Y33}$ . . . disposed from one side of each electrode segment $A_Y$, i.e. from left in FIG. 5 in response to the crossing portion between the electrode elements of the first and second electrode groups 11 and 12 and which are each opposed to each row electrode element X with the above-mentioned predetermined narrow interval d.

The first electrode group 11 and the discharge electrode segment $I_Y$ of the second electrode group 12 may be simultaneously formed by the same conductive layer.

Then, when the first electrode group 11 and the discharge electrode segment $I_Y$ of the second electrode group 12 are formed of the same conductive layer, the discharge electrode segment $I_Y$ and the electrode portion $A_Y$ of the second electrode group 12 are formed by different processes. In this case, as shown in FIGS. 3 to 5, a connecting piece 15 is unitarily formed on each electrode element portion $A_Y$ so as to be extended to the outside of the insulating layer 14 in such a manner that the connecting piece directly contacts with each of the corresponding discharge segments $I_Y$, thereby resulting in the electrical connection being made.

A dielectric layer 16 such as $SiO_2$ or the like is deposited on the whole surface of the first substrate 1 so as to cover the portions in which the first and second electrode groups 11 and 12 are formed except each row electrode terminal $T_X$ and each column electrode terminal $T_A$. On the dielectric layer, there is deposited a surface layer 17 made of MgO, for example, having a work function smaller than that of the dielectric layer 16 and which has an effect for protecting the dielectric layer 16 from being damaged by plasma discharge, if necessary.

Although the surface layer 17 made of MgO or the like may be removed from the band-shaped electrode portion $A_Y$ extending in the column direction of the column electrode Y, if the surface layer is deposited on the whole surface of the dielectric layer 16, then a manufacturing process may be advantageously simplified.

On the other hand, on the inner surface of the second substrate 2, i.e. on the surface of the side opposing the first substrate 1, there are protruded band-like partitions 18 extended in the column direction in an opposing relation to the band-like electrode portions $A_Y$ ($A_{Y1}$, $A_{Y2}$, $A_{Y3}$ . . . ) extended in the column direction of the column electrode element, i.e. the electrode element Y of the second electrode group 12. The height of this partition 18 is selected in such a manner that an interval between the partition 18 and the dielectric layer 16 or the surface layer 17 formed on the surface of the dielectric layer may not produce plasma discharge which will be described later on.

A fluorescent layer 19 on which fluorescent materials R, G and B for emitting lights of red, green and blue colors, for example, are alternatively coated over the wide area including the portions opposing the electrode elements X and Y of the side wall surface and the bottom surface, i.e. in a stripe fashion is formed among the respective partitions 18 on the inner surface of the second substrate 2.

A gas is sealed into a flat space formed between the first and second substrates 1 and 2. As this is gas sealed into the flat space, there is mainly used a mixed gas of more than one kind of, for example, He, Ne, Ar, Xe, Kr, e.g. a so-called Penning gas of a mixed gas of Ne and Xe or a mixed gas of Ar and Xe.

This sealed gas pressure P may be selected in a range of from 0.3 to 5.0 atm.

Then, when a discharge start voltage $V_S$ is selected to be a predetermined voltage, e.g. Paschen minimum value, from Paschen's law, the sealed gas pressure is selected such that a product P·d of this sealed gas pressure P and a distance between the discharge electrodes, i.e. distance d (hereinafter referred to as a discharge electrode distance) between the respective row electrode elements X ($X_1$, $X_2$, $X_3$ . . . ) and discharge electrode portions $I_Y$ ($I_{Y11}$, $I_{Y12}$, $I_{Y13}$ . . . , $I_{Y21}$, $I_{Y22}$, $I_{Y23}$ . . . , $I_{Y31}$, $I_{Y32}$, $I_{Y33}$ . . . ) of the column electrode element Y electrodes which are opposed in a two-dimensional fashion becomes constant. However, when the discharge start voltage $V_S$ is selected to be Paschen minimum value, for example, the discharge electrode distance d may allow a fluctuation of ± several tens of percents relative to the distance d which is determined at that time. Also, when the discharge start voltage $V_S$ is selected to be other values than the Paschen minimum value, the above-mentioned discharge electrode distance may have an allowance of approximately ±30% relative to the discharge electrode distance d which is determined at that time in actual practice.

Then, the discharge electrode distance d may be selected to be a narrow interval such as less than 50 $\mu$m, e.g. 5 to 20 $\mu$m, further less than 5 $\mu$m and 1 $\mu$m or the like.

Figure 6A:
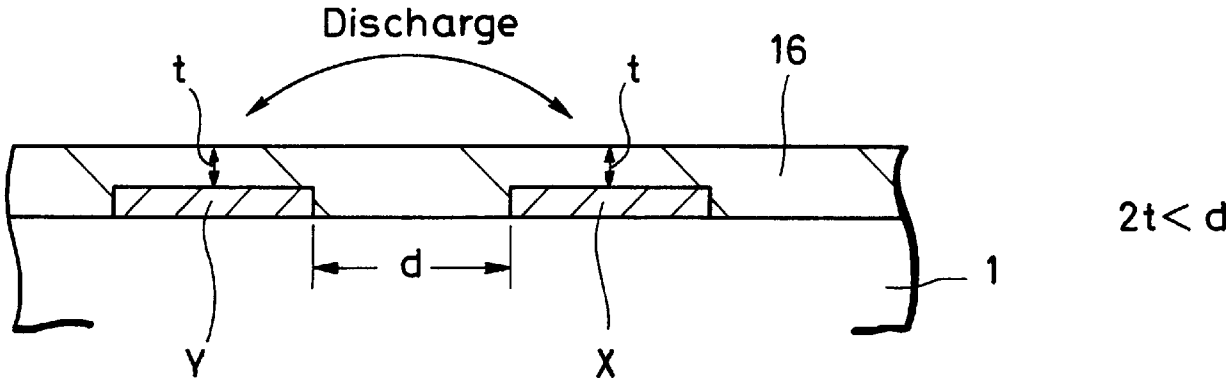
FIGS. 6A and 6B are each a diagram used to explain the manner in which a distance between discharge electrodes is selected.
Figure 6B:
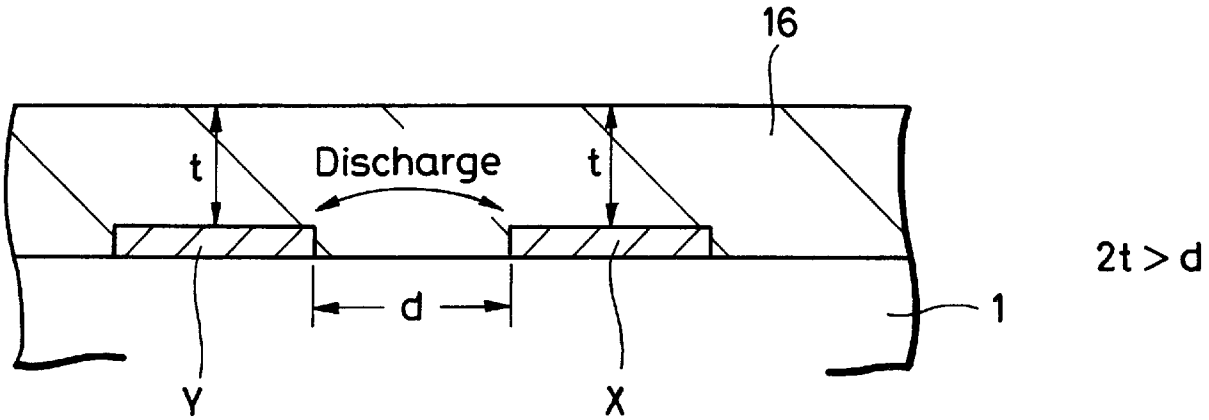

On the other hand, this discharge electrode distance d has also to be selected in relation to a thickness t of the dielectric layer 16. That is, as shown by the discharge mode in FIG. 6A, in order to produce plasma discharge above the dielectric layer 16, the discharge has to be produced through the thickness direction of the dielectric layer 16. As shown in FIG. 6B, it is necessary to avoid that the discharge is produced between the two electrode elements X and Y in the dielectric layer 16. To this end, if a permittivity of the surface layer 17 is sufficiently lower than that of the dielectric layer 16, then it is desired that a relationship between the distance and the thickness may satisfy $2t<d$.

Then, a distance D between electrodes which do not comprise a pair of discharge electrodes obtained other than the opposing portions of the row electrode elements X and the discharge electrode segments $I_Y$ ($I_{Y11}$, $I_{Y12}$, $I_{Y13}$ . . . , $I_{Y21}$, $I_{Y22}$, $I_{Y23}$ . . . , $I_{Y31}$, $I_{32}$, $I_{Y33}$ . . . ) of the electrode elements Y which become opposing electrodes comprising each pair of discharge electrodes is selected to be sufficiently larger than the discharge electrode distance d, i.e. $D>d$.

Next, an operation of the thus arranged display device will be described. In this display device, plasma discharge may be produced in the gas space between the second substrate and the pair of discharge electrodes applied with the voltage on the dielectric layer 16 (on the surface layer if the surface layer 17 is formed on the dielectric layer) by applying an AC voltage higher than the discharge start voltage to the portion between the predetermined, e.g. the selected row electrode elements $X_1$, $X_2$, $X_3$ . . . and the column electrode elements $Y_1$, $Y_2$, $Y_3$ . . . of the first and second electrode groups 11 and 12 forming the pair of discharge electrodes, in the above-mentioned example, between the row electrode elements $X_1$, $X_2$, $X_3$ . . . and the discharge electrode segments $I_{Y11}$, $I_{Y12}$, $I_{Y13}$ . . . , $I_{Y21}$, $I_{Y22}$, $I_{Y23}$ . . . , $I_{Y31}$, $I_{Y32}$, $I_{Y33}$ . . .

That is, in this case, the portion opposing the discharge electrode segment $I_Y$ of each column electrode element Y relative to each row electrode element Y with the distance d and the nearby portion becomes a unit discharge region.

Then, when plasma discharge is produced as described above, the fluorescent materials R, G, B disposed in the discharge space of this unit discharge region are excited to emit light by resultant ultraviolet rays, for example.

By applying successively a predetermined voltage to the row electrode elements $X_1$, $X_2$, $X_3$ . . . in a time-division manner and applying the discharge start voltage to the respective column electrode elements $Y_1$, $Y_2$, $Y_3$ . . . in response to display information in synchronism therewith, plasma discharge may be produced in the unit discharge region corresponding to target display information to excite the fluorescent materials R, G, B, thereby resulting in one pixel of adjacent fluorescent materials R, G, B, i.e. one color picture element being displayed.

In this case, the column direction of each unit discharge region is restricted by the voltage applied to the row electrode elements $X_1$, $X_2$, $X_3$ . . . , and the row direction thereof is restricted when the occurrence of plasma discharge is restricted by the existence of the partition 18, thereby avoiding the cross-talk from being caused.

The light emission and display produced by the planar plasma discharge display device according to the present invention may be observed from the first substrate 1 side or the second substrate 2 side. In this case, at least the substrate 1 or 2 from which the light emission and display may be observed is formed of the transparent substrate for passing display light, e.g. glass substrate as mentioned before. When the two substrates 1 and 2 are formed of the transparent substrate, if a light reflecting film or light shielding film (not shown) such as an Al vapor-deposition film or the like is formed on the inner surface of the substrate 2 or 1 on the side opposite to the observation side before each electrode group or the fluorescent layer is formed, then emitted light may be effectively introduced into the observation side, and external incident light from the back surface side may be shielded, thereby making it possible to increase a contrast.

When the light emission and display are observed from the first substrate 1 side in which the electrode groups are formed, the respective electrode elements of the first and second electrode groups 11 and 12 are formed of transparent conductive layers, e.g. ITO (composite oxide of In and Sn).

Figure 7:
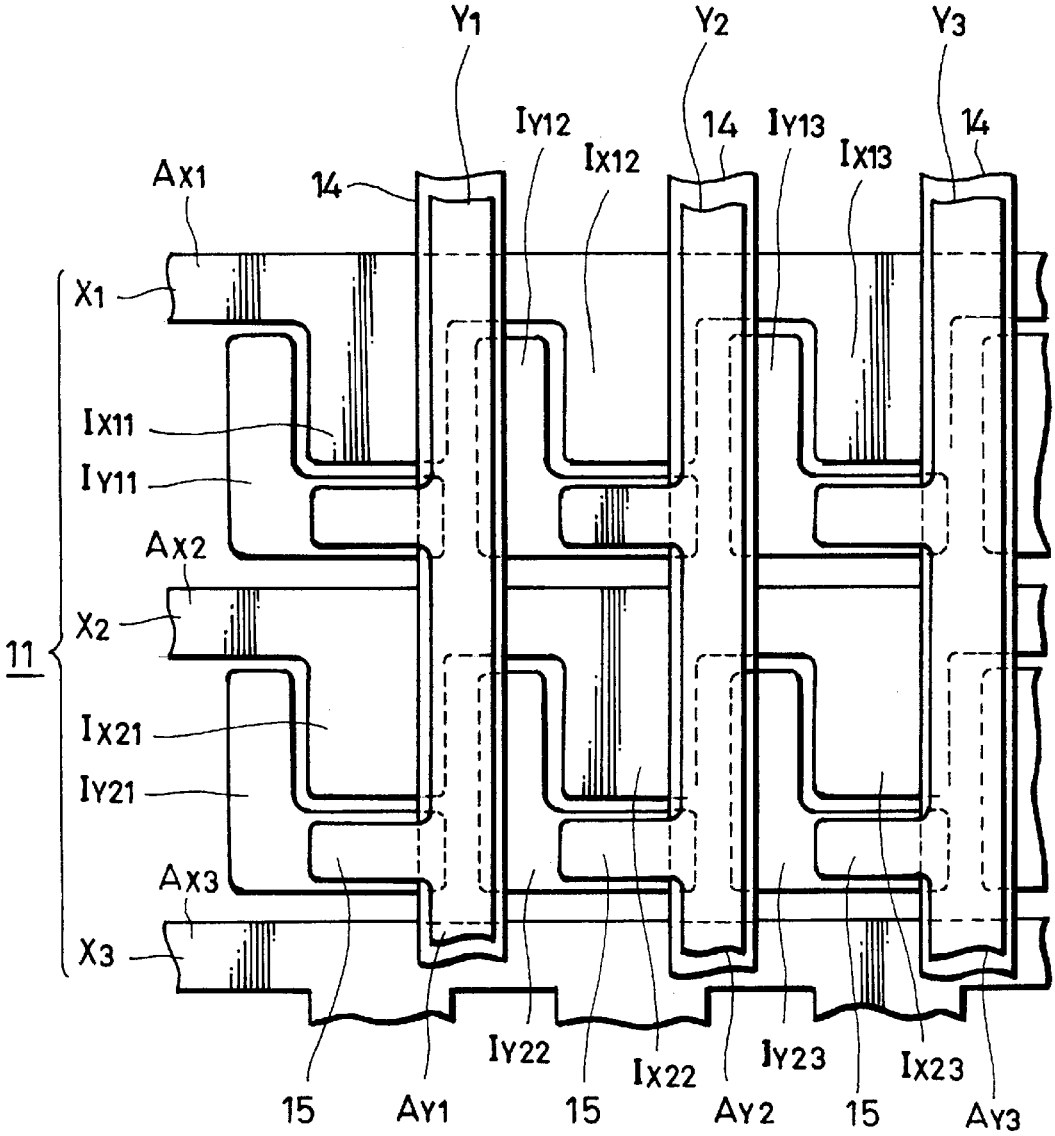
FIG. 7 is a pattern diagram of other example of the device according to the present invention.
Figure 8:
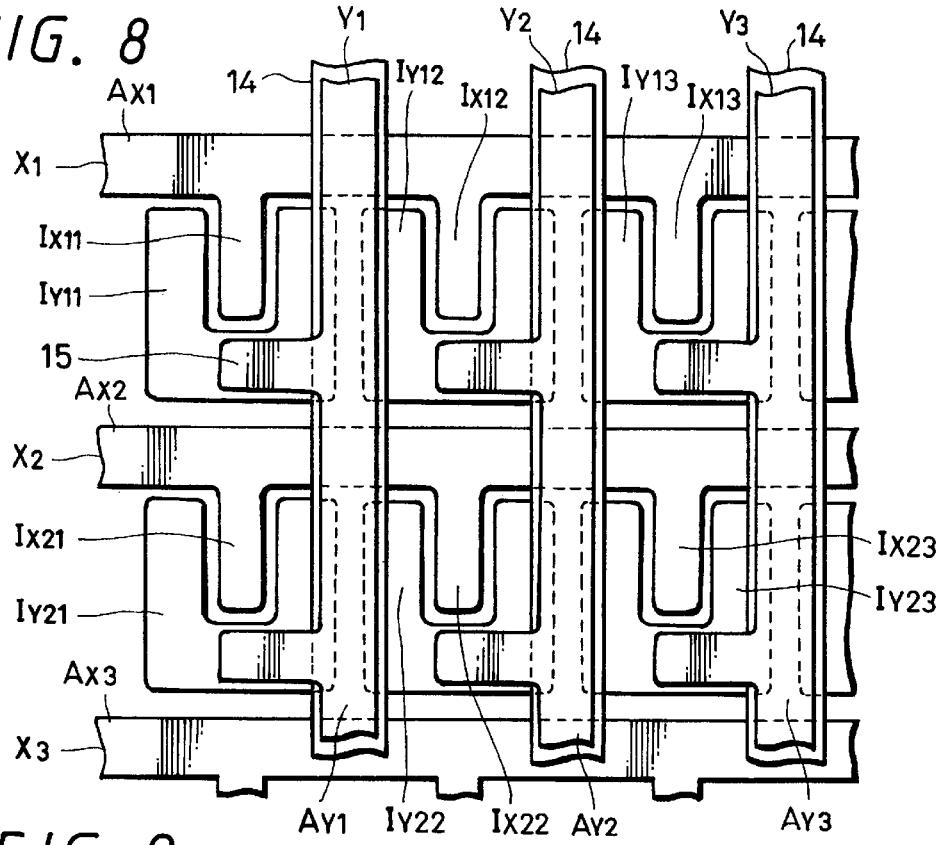
FIG. 8 is a pattern diagram of other example of the device according to the present invention.
Figure 9:
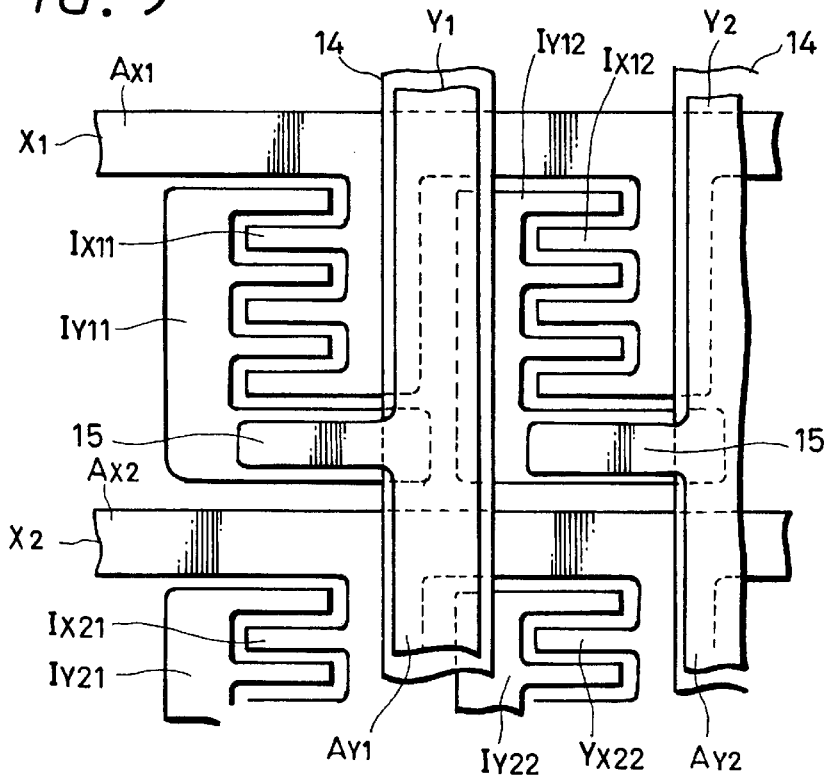
FIG. 9 is a pattern diagram of other example of the device according to the present invention.

While only each electrode element Y of the second electrode group 12 is comprised of the discharge electrode segment $I_Y$ and the feeding electrode portion $A_Y$ and the electrode element X of the first electrode group 1 is formed as the band-like pattern in which the feeding portion and the discharge electrode portion are made common as shown by the pattern diagram in FIG. 5 in the above-mentioned example, in order to increase a light emission brightness by enlarging the plasma discharge region, as shown in FIGS. 7 to 9, for example, the electrode element X of the first electrode group 11 is comprised of the band-shaped feeding electrode portions AX ($A_{X1}$, $A_{X2}$, $A_{X3}$ . . . ) extended in the row direction and the discharge electrode segments $I_X$ ($I_{X11}$, $I_{X12}$, $I_{X13}$ . . . , $I_{X21}$, $I_{X22}$, $I_{X23}$ . . . , $I_{X31}$, $I_{X32}$, $I_{X33}$ . . . ) extended in the column direction.

Then, as shown in FIG. 7, for example, the discharge electrode segment $I_X$ of each electrode element X of the first electrode group 11 may be formed as substantially a rectangular pattern and the discharge electrode segment $I_Y$ of each electrode element Y of the second electrode group 12 may be formed as an L-shaped pattern so as to oppose the two sides of the former with a distance d.

Alternatively, as shown in FIG. 8, for example, the discharge electrode segment $I_X$ of each electrode element X of the first electrode group 11 may be formed as substantially I-shaped pattern and the discharge electrode segment $I_Y$ of each electrode element Y of the second electrode group 12 may be formed as a U-shaped pattern so as to surround the above-mentioned pattern with a distance d.

Further, alternatively, as shown in FIG. 9, for example, the discharge electrode segments $I_X$ and $I_Y$ of the respective electrode elements X and Y of the first and second electrode groups 11 and 12 may be formed as zigzag-shaped patterns which oppose to each other with a distance d.

In FIGS. 7 to 9, parts corresponding to those of FIG. 5 are marked with the same reference numerals and an overlapping explanation therefor is omitted.

Next, in order to facilitate the understanding of the thus arranged display device, an example of its manufacturing method will be described. In this example, the row electrode elements X ($X_1$, $X_2$, $X_3$ . . . ) and the discharge electrode segments $I_Y$ ($I_{Y11}$, $I_{Y12}$, $I_{Y13}$ . . . , $I_{Y21}$, $I_{Y22}$, $I_{Y23}$ . . . , $I_{Y31}$, $I_{Y32}$, $I_{Y33}$ . . . ) of the column electrode elements Y ($Y_1$, $Y_2$, $Y_3$ . . . ) are formed by the same conductive layer, i.e. same process.

Figure 10:
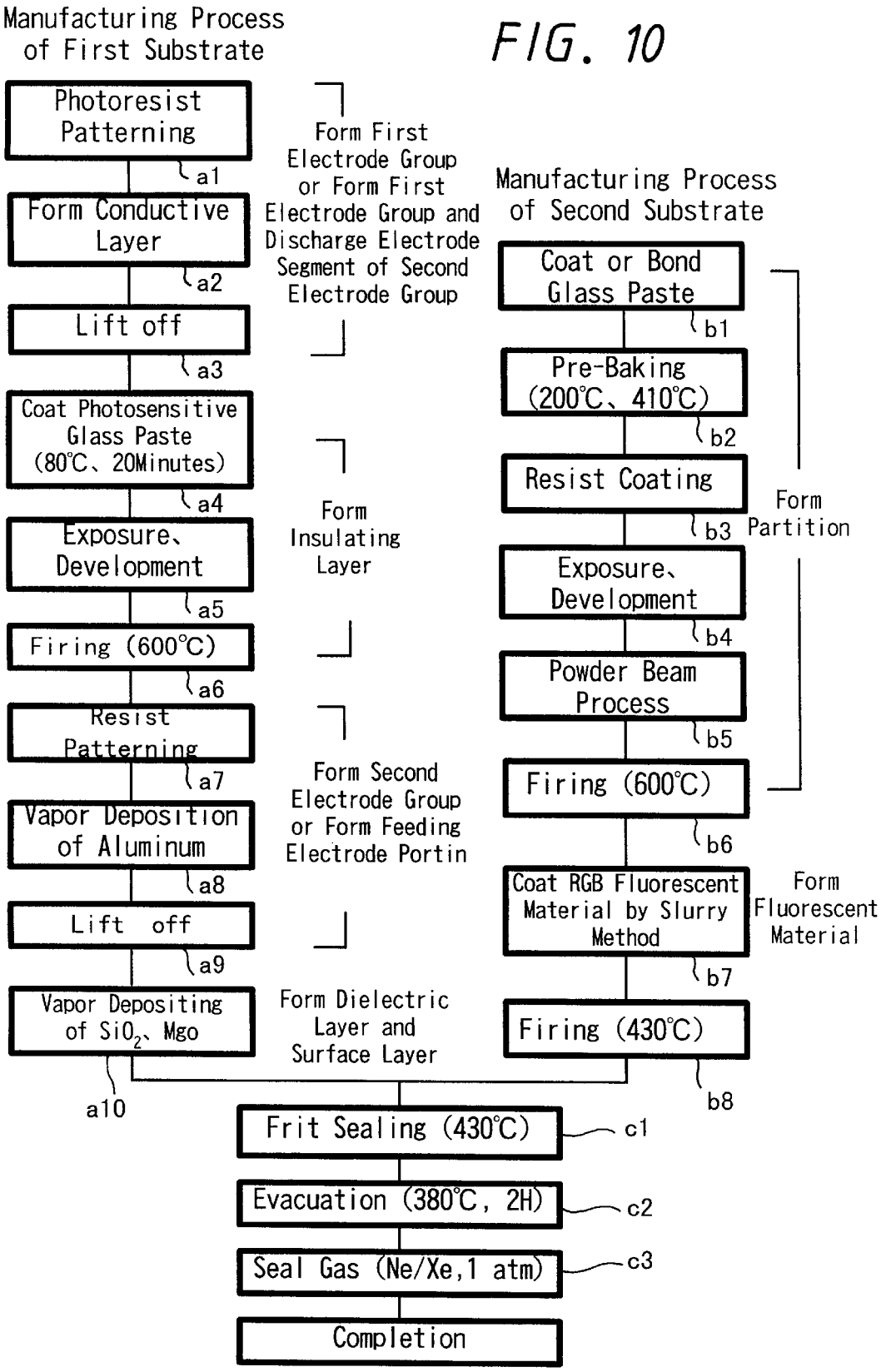
FIG. 10 is a diagram used to explain an example of a method for manufacturing a device according to an embodiment of the present invention.

FIG. 10 is a flowchart showing this manufacturing method.

Initially, a manufacturing process concerning the first substrate 1 will be described. There is prepared the first substrate 1 formed of a glass substrate, for example. A photo resist layer is coated on the whole surface of its one major surface, and this resist layer is treated by patterning (process $a_1$). In this patterning process, the photo resist layer is removed from the portions in which each electrode element X of the finally formed first electrode group 11 and the discharge electrode segment $I_Y$ of the electrode element Y of the second electrode group 12 are formed by pattern-exposing and developing the photo resist layer.

Then, a conductive layer forming each electrode element X of the first electrode group 11 and the discharge electrode segment IY of each electrode element Y of the second electrode group 12 is deposited on the whole surface of the first substrate 1 including the removed portion of the photo resist layer by vapor deposition (process $a_a$), for example.

This conductive layer may be formed of an ITO of a transparent conductive layer, for example, and a metal layer of more than one kind of Al, Cu, Ni, Fe, Cr, Zn, Au, Ag, Pb and so on or a laminated layer structure of Cr/Al having an Al layer and a surface layer such as a Cr layer or the like formed thereon to block the Al from being oxidized, or a conductive layer of a multilayer structure of Cr/Al/Cr having an underlayer formed of a Cr layer, for example, having an excellent deposition property relative to the glass substrate, for example.

The photo resist layer is stripped by a stripper, the conductive layer formed on the photo resist layer is removed together with the photo resist layer, i.e. lifted off, thereby the conductive layer being patterned (process $a_3$)

Figure 11:
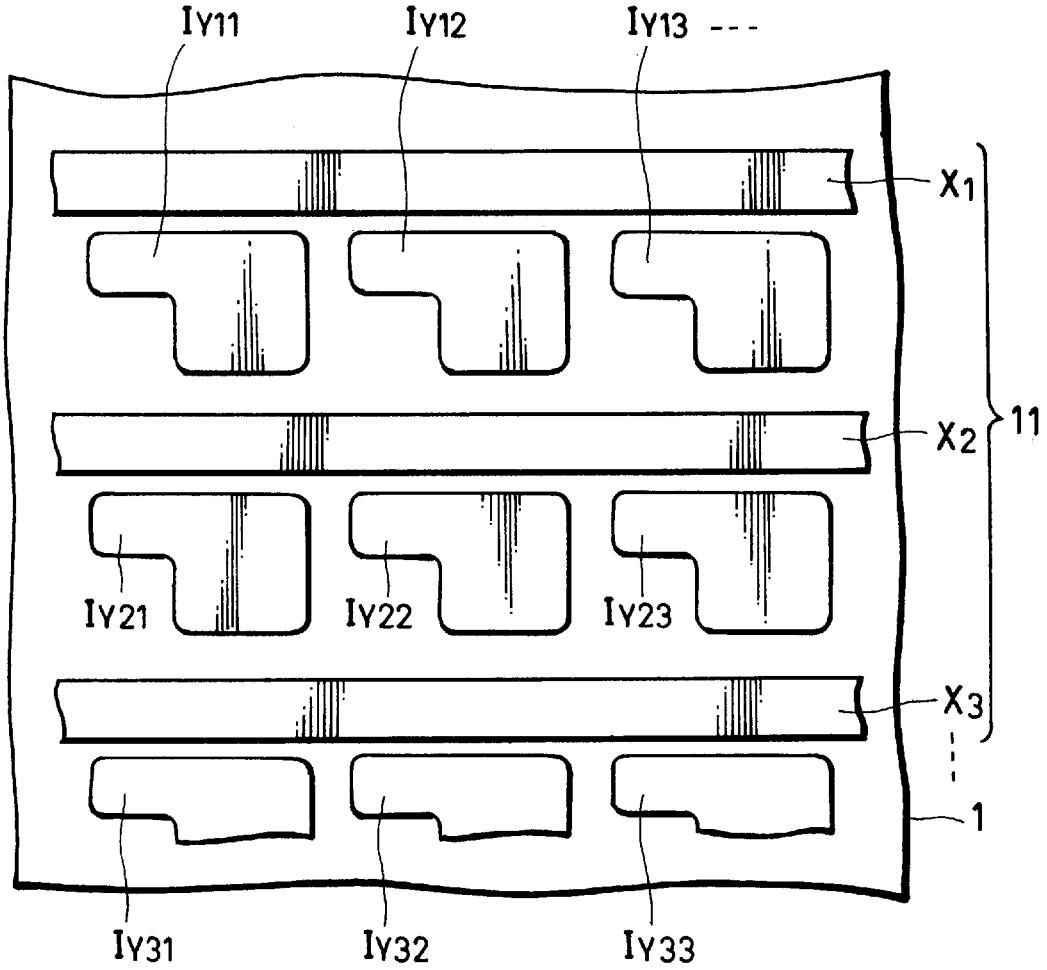
FIG. 11 is a plan view of a main portion of a first substrate in one process of an example of a method for manufacturing a device according to an embodiment of the present invention.

In this manner, the conductive layer is patterned, and only each electrode element X of the first electrode group 11 and the discharge electrode segment IY of each electrode element Y of the second electrode group 12*a* are formed as shown in FIG. 11, for example.

Figure 12:
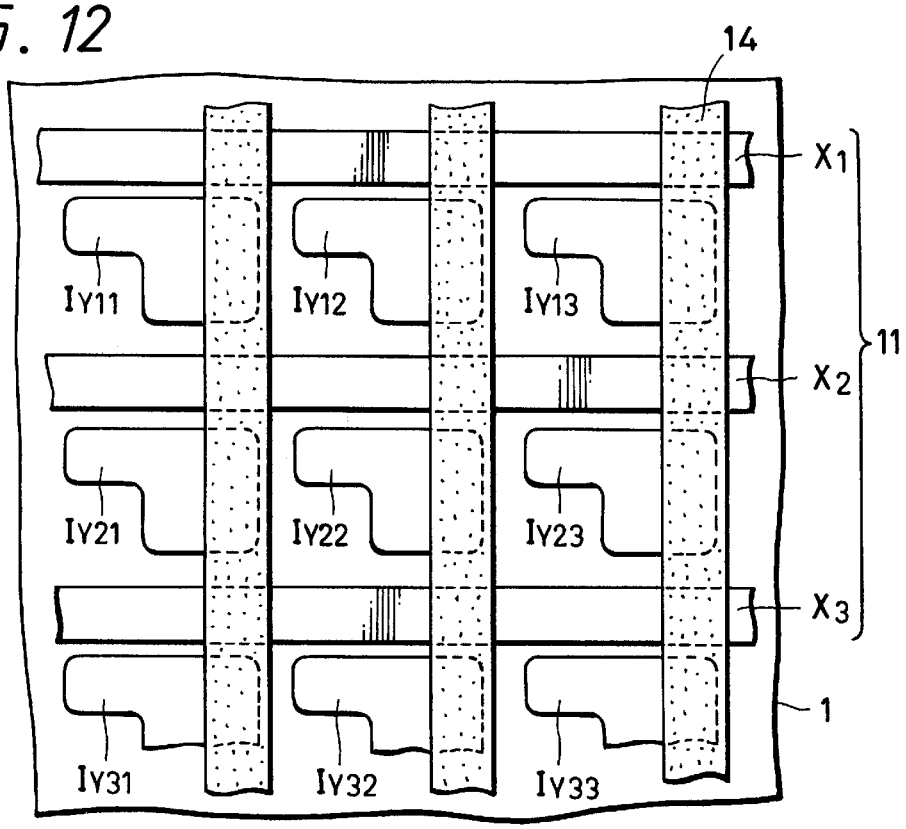
FIG. 12 is a plan view of a main portion of a first substrate in one process of an example of a method for manufacturing a device according to an embodiment of the present invention.

Then, as shown in FIG. 12, there is formed the insulating layer 14. When this insulating layer 14 is formed, for example, a photosensitive glass paste forming the insulating layer is coated on the whole surface of the first substrate 11 on which there are formed each electrode element X of the first electrode group 11 and the discharge electrode segment $I_Y$ of each electrode element Y of the second electrode group 12, and treated by heat at 80° C. for 20 minutes (process $a_4$). Thereafter, by pattern-exposing and developing this glass layer, a band-like pattern crossing the respective electrode elements X ($X_1$, $X_2$, $X_3$ . . . ) is formed on each one side edge of the discharge electrode segments $I_Y$ ($I_{Y11}$, $I_{Y12}$, $I_{Y13}$ . . . , $I_{Y21}$, $I_{Y22}$, $I_{Y23}$ . . . , $I_{Y31}$, $I_{Y32}$, $I_{Y33}$ . . . ) each arrayed on the same column line (process $a_5$). Thereafter, a product is fired at 600° C. (process $a_6$). In this manner, there may be formed the insulating layer 14.

Then, as shown in FIG. 5, there are formed the electrode portions $A_Y$ ($A_{Y1}$, $A_{Y2}$, $A_{Y3}$ . . . ) of the second electrode group 12 and the connection pieces 15 extended from the electrode portions. When they are formed, they may be formed by the lift off method. That is, also in this case, a photo resist layer is coated on the whole surface of the first substrate 1 and the photo resist is treated by patterning according to pattern exposure and development ($a_7$). Thereafter, a conductive layer made of Al, for example, is deposited on the whole surface by vapor deposition or the like (process $a_8$), the photo resist layer is stripped off, the conductive layer is removed together with the photo resist layer formed on the conductive layer by lift off (process $a_9$), whereby the electrode portions $A_Y$ ($A_{Y1}$, $A_{Y2}$, $A_{Y3}$ . . . ) of the second electrode group 12 and the connection pieces 15 extended from the above electrode portions are formed simultaneously.

In this manner, the first and second electrode groups 11 and 12 are formed.

Thereafter, the dielectric layer 16 such as $SiO_2$ or the like is deposited on the whole surface except the terminal leading-out portion such as $T_{X1}$, $T_{X2}$, $T_{X3}$ . . . $T_{Y1}$, $T_{Y2}$, $T_{Y3}$ . . . formed at the end portions of the respective electrode elements X and Y, for example, i.e. outer peripheral portion of the substrate 1 by the CVD (chemical vapor deposition) method. The surface layer 17 such as MgO or the like is deposited on the dielectric layer by vapor deposition, for example (process $a_{10}$).

A manufacturing process concerning the second substrate 2 will be described next. Also in this case, there is prepared the second substrate 2 formed of the glass substrate, for example. The aforementioned partition 18 is formed on one major surface of the second substrate. To this end, initially, a photo resist layer, for example, is coated on the whole surface of the substrate 2 at its surface on which the partition 18 is formed or a laminate glass material sheet, for example, GREEN SHEET (trade name manufactured by The Du Pont Company) is bonded to the whole surface of the substrate (process $b_1$), and pre-baked at 210° C. or 410° C. (process $b_2$).

Thereafter, a photo resist layer is coated (process $b_3$), and the photo resist layer is removed from other portions than the portion in which the partition 18 is formed, i.e. the photo resist layer is left in the pattern of the partition 18 (process $b_4$).

Then, this photo resist layer is used as a mask, and other portions are removed by powder beam work or so-called sand blast process while the portion in which the photo resist layer is formed is left (process $b_5$).

Thereafter, the product is sintered at 600° C., for example. If so, the photo resist layer is vanished, and the glass partition 18 is formed of glass (process $b_6$).

On the inner surface of the second substrate 2 on which the stripe-shaped partition 18 was formed, there are formed red, green and blue fluorescent materials R, G and B at every two concave portions between the partitions 18 by sequentially coating fluorescent slurries (process $b_7$). Then, the fluorescent material 19 is formed by firing the product at, for example, 430° C. (process $b_8$).

The first substrate 1 in which the first and second electrode groups 11 and 12 are formed and the second substrate 2 in which the partition 18 and the fluorescent layer 19 are formed as described above are opposed to each other with a predetermined interval under the condition that the respective electrode portions AY of each electrode element Y of the second electrode group 12 are faced to the respective partitions 18 of the second substrate 2, and their peripheral portions are sealed with glass frit by heat treatment at, for example, 430° C. (process $c_1$).

The frit position in this case is selected to be the position from which the terminal portions $T_X$ and $T_Y$ of respective electrode elements are led out to the outside.

The flat space formed between the first and second substrates 1 and 2 as described above is evacuated for two hours under the condition that it is heated at, for example, 380° C. (process $c_2$). Then, the aforementioned gas is sealed into this flat space at a predetermined gas pressure (process $C_3$). In this manner, there is arranged a planar type plasma discharge display device according to the present invention.

Incidentally, when the heat treatment at a high temperature described at, for example, the process $a_6$ is executed after the electrode groups of the lower layer, in this example, the first and second electrode groups 11 and 12 were formed, if the conductive layer formed before such high-temperature treatment, i.e. in the above-mentioned example, the respective electrode elements X of the first electrode group 11 and the respective discharge electrode segments $I_Y$ of the respective electrode elements Y of the second electrode groups 12 are made of Al, for example, there is then the problem that disadvantages of deterioration of characteristics such as the oxidization of Al occur or the like. In this case, as described before, it is desired that this conductive layer should be formed as a multilayer structure in which Cr forming a bad conductor for protecting Al and which is stable against the oxidization is formed on the aluminum.

While the respective electrode groups 11 and 12 are formed by the lift off according to the above-mentioned method, the respective electrode groups may be formed by pattern-etching a conductive layer with photolithography after the conductive layer was formed on the whole surface. Thus, the method of the present invention is not limited to the above-mentioned example, and various methods may be applied.

Figure 13:
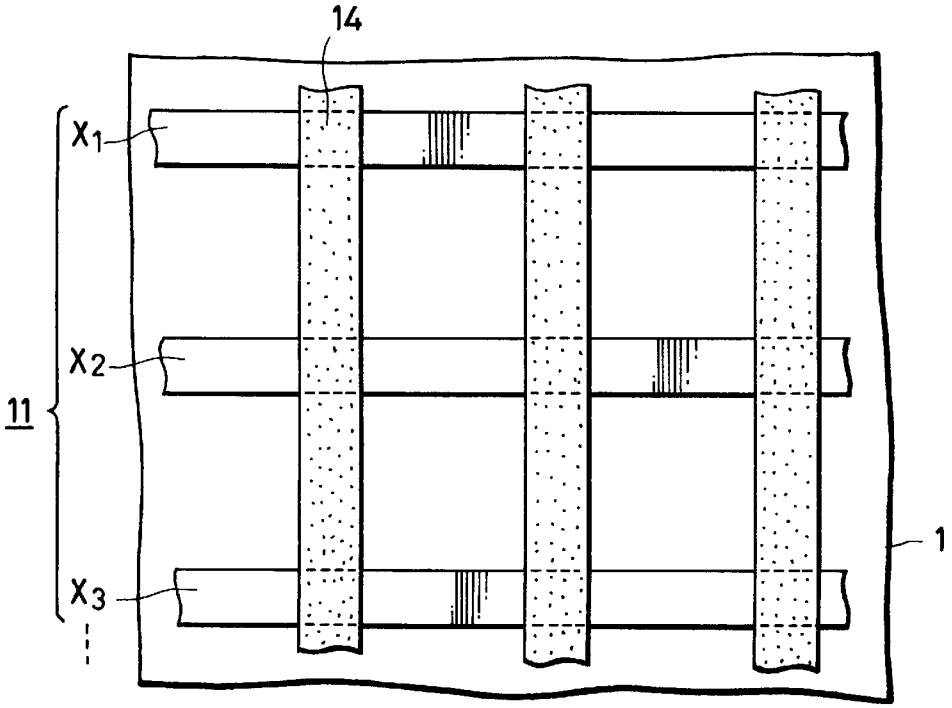
FIG. 13 is a plan view of a main portion of a first substrate in one process of other example of a method for manufacturing a device according to an embodiment of the present invention.
Figure 14:
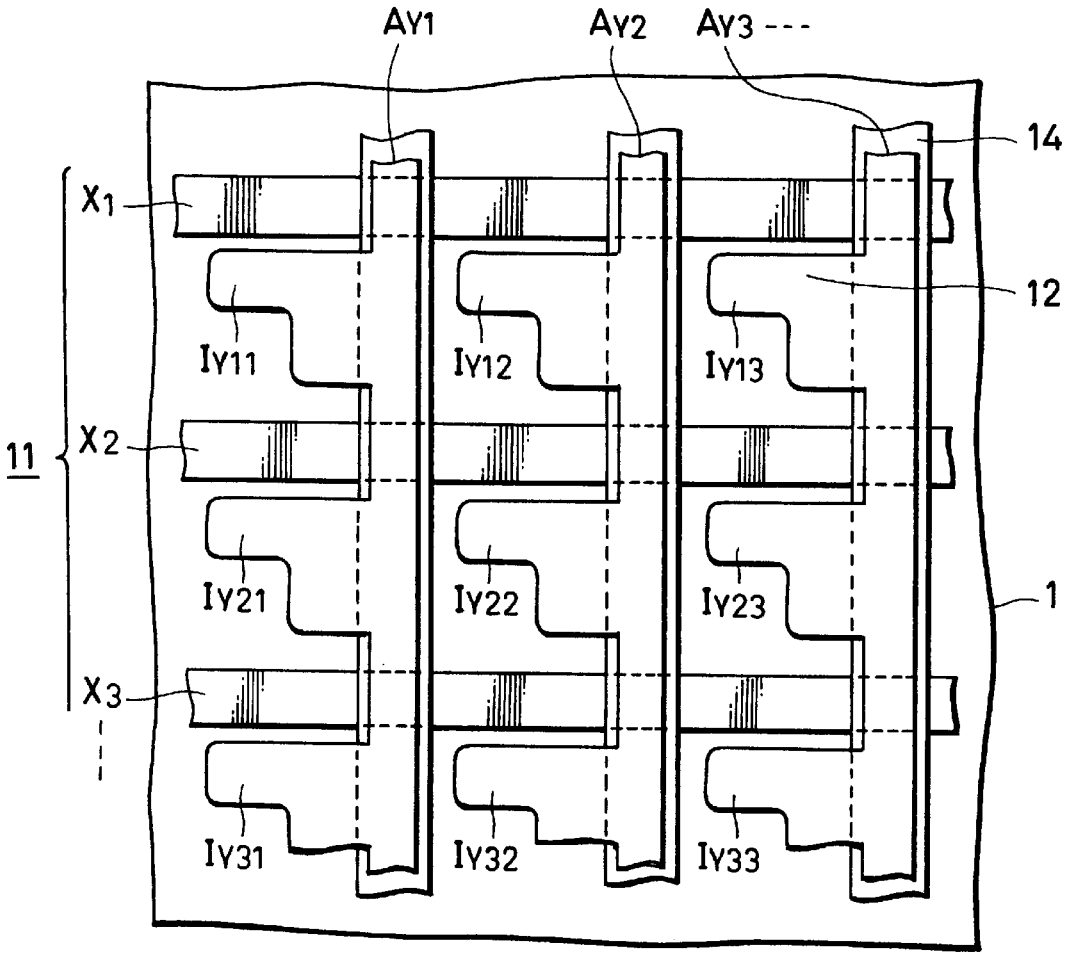
FIG. 14 is a plan view. of a main portion of a first substrate in one process of other example of a method for manufacturing a device according to an embodiment of the present invention.

While the electrode elements X of the first electrode group 11 and the discharge electrode segments $I_Y$ of the electrode elements Y of the second electrode group 12 are formed of the same conductive layer through the same process as described above, the discharge electrode segments $I_Y$ of the electrode elements Y of the second electrode group 12 and the so-called feeding electrode portions $A_Y$ may be composed of the same conductive layer by processes different from those of the first electrode group 11, That is, in this case, only the electrode elements X of the first electrode group 11 whose pattern is shown in FIG. 13 are formed by the aforementioned processes $a_1$ to $a_3$. Thereafter, the insulating layer 14 is formed by the aforementioned processes $a_4$ to $a_6$. Thereafter, by the aforementioned processes $a_7$ to $a_{10}$, as shown in FIG. 14, the electrode portions $A_Y$ of the electrode elements Y of the second electrode group 12 and the discharge electrode portions $I_Y$ extended from the above electrode portions may be formed. In this case, the connection piece 15 is omitted.

While the insulating layer 14 and the dielectric layer 16 are formed respectively in the above-mentioned example, these layers may be formed of the same material layer such as, for example, $SiO_2$ glass layer or the like. In this case, in the above-mentioned processes $a_4$ to $a_6$, the dielectric layer 16 is formed simultaneously, and contact holes are formed through the overlapping portions between the electrode portions $A_Y$ of the respective discharge electrode segments $I_Y$ and the respective electrode portions $A_Y$ of the electrode elements Y of the second electrode group 12 when the respective electrode portions $A_Y$ contact with the discharge electrode segments $I_Y$ of the lower layer.

While the above-mentioned respective manufacturing methods are not limited to the pattern of FIG. 5, it is needless to say that the above-mentioned respective manufacturing methods may be applied to the case in which the electrode elements X ($X_1$, $X_2$, $X_3$ . . . ) of the first electrode group 11 shown in FIGS. 7 to 9, for example, are comprised of the electrode portions AX (AX1, AX2, $A_{X3}$ . . . ) and the discharge electrode segments $I_X$ ($I_{X11}$, $I_{X12}$, $I_{X13}$ . . . , $I_{X21}$, $I_{X22}$, $I_{X23}$ . . . , $I_{X31}$, $I_{X32}$, $I_{X33}$ . . . ) which are extended from the electrode portions in the column direction.

Incidentally, while the display device is of the AC driving type in the above-mentioned example, the display device may be arranged as the DC driving type. In this case, the dielectric layer 16 and the surface layer 17 are not formed. Then, in the case of this DC discharge, since the electrode on the cathode side is oxidized and the electrode on the anode side is reduced by the discharge, the electrode elements comprising the first or second electrode group 11 or 12 which becomes the electrode on the anode side may be made of oxide metal such as ITO, $SnO_2$, $In_2O_3$ or the like and the electrode elements comprising the second or first electrode group 12 or 11 which becomes the electrode on the cathode side may be made of metal electrode such as Al, Cu, Ni, Fe, Cr, Zn, Au, Ag, Pb and so on or alloy of more than one kind of the above-mentioned metals.

Accordingly, in this case, it is not preferable that the first electrode group 11 and the second electrode group 12 are formed of the same conductive layer. In this case, in the respective electrode elements Y of the second electrode group 12, the electrode portion $A_Y$ and the discharge portion $I_Y$ thereof are made of the same conductive layer.

Also, in any case the display device is of the AC or DC driving type, if the electrode X of the first electrode group 11, for example, is made of an oxide electrode such as a transparent electrode or the like, then its specific resistance is generally large. Therefore, in this case, a conductive layer such as Al, Ni, Cu or the like having an excellent conductivity should preferably be deposited on one side edge extended along the band-shaped electrode element in the row direction.

According to the planar type plasma discharge display device of the present invention, since the first and second electrode groups 11 and 12 which serve as the respective discharge electrodes are formed on the common substrate, in the above-mentioned example, the first substrate 1 comprising the flat receptacle, the interval between these electrodes may be set accurately. Thus, the display device having a satisfactory and high accuracy may be stably manufactured with ease.

Then, since the first and second electrode groups 11 and 12 which serve the respective discharge electrodes are formed on the common substrate, it may be avoided that the distance d between the discharge electrodes and the interval obtained when these electrode groups are formed on the opposing substrates, i.e. discharge space or the like are restricted to each other. Thus, these intervals may be selected with an increased freedom so that the designing and the manufacturing of the display device may be simplified.

Also, since the discharge electrodes and the fluorescent materials are formed on the different substrates 1 and 2, the fluorescent material may be coated on the portions opposing the respective electrode elements, i.e. as shown in FIG. 4, not only on the side surface of the partition 18 but also on the bottom surface of the partition, thereby making it possible to increase a brightness.

As described above, according to the arrangement of the present invention, since the discharge electrodes and the fluorescent materials are formed on the different substrates 1 and 2, as mentioned in the beginning, the coated area of the fluorescent material increases considerably as compared with the case in which the discharge electrodes and the fluorescent materials are formed on the same substrate, thereby increasing the brightness.

Also, according to the arrangement of the present invention, since the first and second electrode groups 11 and 12 which serve the respective discharge electrodes are formed on the common substrate, in the above-mentioned example, the first substrate 1 comprising the flat receptacle, it is possible to set the interval between these electrodes.

Further, when the color display device with the fluorescent layer formed thereon is formed, since the substrate on which the fluorescent layer is formed and the substrate on which the respective electrode groups 11 and 12 are formed are the different substrates, its manufacturing may be made easy, and its productivity may be increased. Also, when the respective electrode groups and the fluorescent layer are formed, accidents for deteriorating characteristics such as damaging the elements each other may be avoided so that a yield may be improved.

Also, since the first and second electrode groups 11 and 12 serving as the respective discharge electrodes are formed on the common substrate, the interval d between the respective electrode elements X and Y comprising the discharge electrode and the discharge space, i.e. interval between the first and second substrates 1 and 2 are avoided from being restricted each other. Thus, the above-mentioned intervals may be selected with an increased freedom, and hence the designing and the manufacturing may be simplified.

As described above, according to the planar type plasma discharge display device of the present invention, since a highly-reliable display device with a high accuracy, accordingly, with stable characteristics may be easily manufactured with an excellent work efficiency, accordingly, mass-produced. Thus, its industrial advantage is extremely large.

A further example of the planar type plasma discharge display device according to the present invention comprises a first electrode group and a second electrode group. The first electrode group is formed by arraying a plurality of electrode elements extended in a first direction, and the second electrode group is formed by arraying a plurality of electrode elements extended in a direction crossing the first direction.

The electrode elements of the second electrode group form adjacent four electrode elements into one set, and a common terminal is led out from every other electrode elements in each set.

Then, a plasma discharge portion is formed in response to a portion in which every other electrode elements of the first electrode group and corresponding two adjacent electrode elements in each set of the second electrode group cross each other.

Then, a desired image is displayed by sequentially or simultaneously producing plasma discharge between predetermined, e.g. selected electrode elements of the first and second electrode groups.

This discharge may be carried out with application of AC or DC voltage.

According to an embodiment of the present invention, the first and second electrode groups are formed on a common substrate in a two-dimensional fashion.

Also, a planar type plasma display device according to the present invention may be formed of a planar display receptacle in which first and second substrates at least one of which is formed of a transparent substrate for passing display light, e.g. glass substrate, are opposed to each other with a predetermined interval, peripheral portions of the first and second substrates are sealed airtight by glass frit, for example, and a flat gas space is formed between the first and second substrates.

Then, the first substrate is used as the above-mentioned common substrate on which the first and second electrode groups may be formed. However, while the first substrate itself is not limited to the common substrate on which the first and second electrode groups are formed as described above, other substrate on which the first and second electrode groups are formed may be disposed on the first substrate in an abutting fashion.

A fluorescent layer is formed on the second substrate of the above-mentioned planar display receptacle. In a color display device, for example, this fluorescent layer is formed by separately coating red, green and blue fluorescent materials, for example. In a monochromatic display device, this fluorescent layer is formed by coating a fluorescent material of a single color.

A partition for partitioning a unit discharge region is formed on the second substrate of the above-mentioned planar display device.

In the above-mentioned arrangement, when a plasma display device of AC driving type is arranged, a dielectric layer is formed over a portion in which at least one of the first and second electrode groups is formed.

On this dielectric layer, there may be formed a surface layer having a work function smaller than that of this dielectric layer and which may protect the surface of the dielectric layer from being damaged by plasma discharge.

Electrode elements of any one of or both of the first and second electrode groups are comprised of discharge electrode segments for producing plasma discharge between them and electrode elements of other electrode groups and electrode portions extended in the first and second directions.

Insulating layers are interposed at a portion in which the electrode elements of the first and second electrode groups extended in the first and second directions cross to each other to thereby electrically insulate the electrode elements of the first and second electrode groups.

Then, a discharge electrode segment is formed on at least one electrode element of the first or second electrode group in response to the crossing portion of the electrode elements of the first and second electrode groups. A plasma discharge segment is formed between this discharge electrode segment and a discharge electrode segment or electrode element of other electrode group. An interval between the discharge electrode segments for forming these plasma discharge segments or an interval between the discharge electrode segment and the electrode element is selected to be a narrow interval d which enables plasma discharge to be generated with application of a predetermined discharge start voltage. An interval between the electrode elements of the adjacent first and second electrode groups wherein plasma discharge should be avoided although a similar voltage is applied is selected to be larger than the above-mentioned interval d.

The electrode element of the first electrode group and the discharge electrode segment of the electrode element of the second electrode group may be formed of the same conductive layer. That is, the electrode element of the first electrode group and the discharge electrode segment of the second electrode element may be formed of the same conductive layer with the same process. If so, since the opposing portions of the respective plasma discharge portions are formed simultaneously, the above-mentioned intervals d in the respective plasma discharge portions may be set accurately.

However, the electrode elements of the first electrode group and the second electrode elements may be formed of conductive layers with different processes.

Then, a fluorescent layer, e.g. a fluorescent surface in which fluorescent materials R, G and B for emitting light of red, green and blue is formed on the second substrate when a color image is displayed.

The band-shaped partition is formed on the second substrate on which this fluorescent layer is formed as described above. This band-shaped partition is protrusively opposed along the electrode portion extended in the second direction of the electrode element of the second electrode group, i.e. along the column direction. This partition is adapted to block a cross-talk produced between the respective unit discharge regions.

A planar type plasma display device according to the present invention will be described with reference to the drawings. The device according to the present invention is not limited to the arrangement of these examples.

Figure 15:
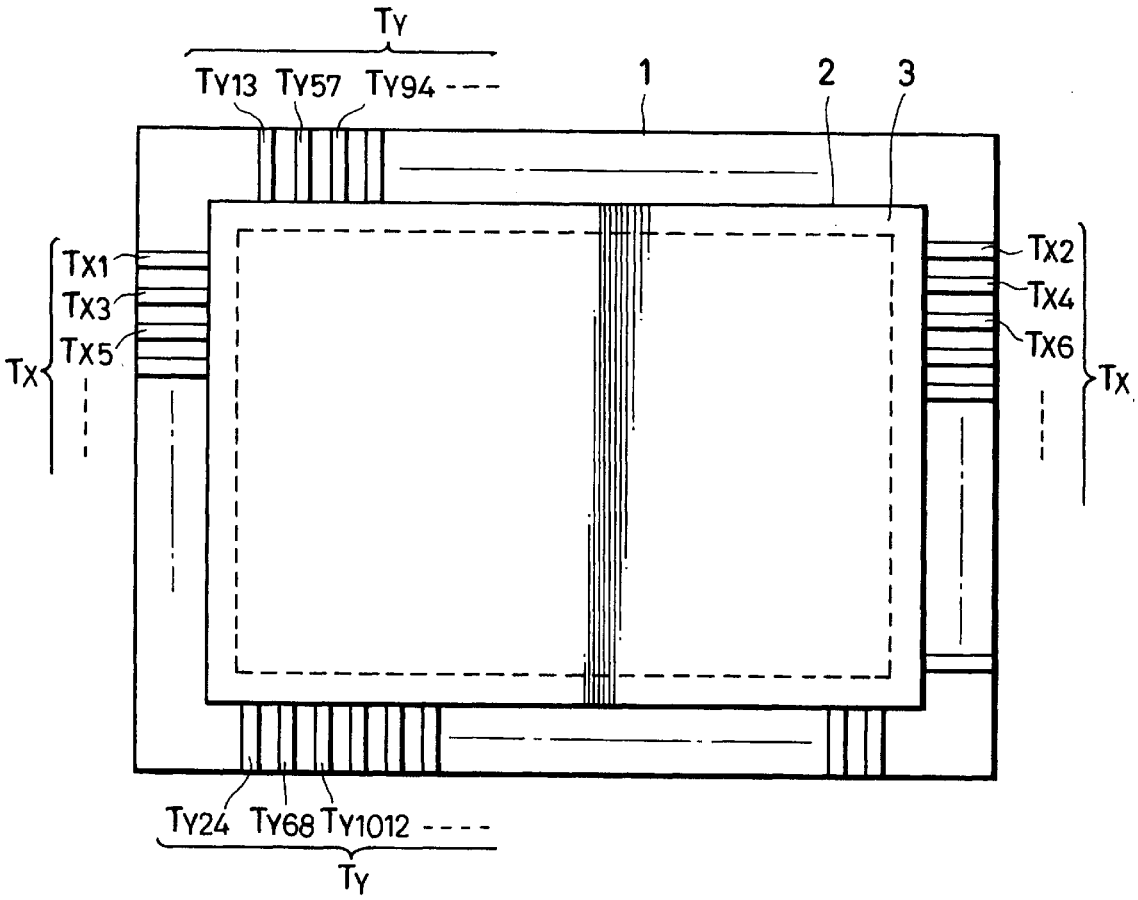
FIG. 15 is a plan view of a planar type plasma discharge display device according to an embodiment of the present invention.
Figure 16:
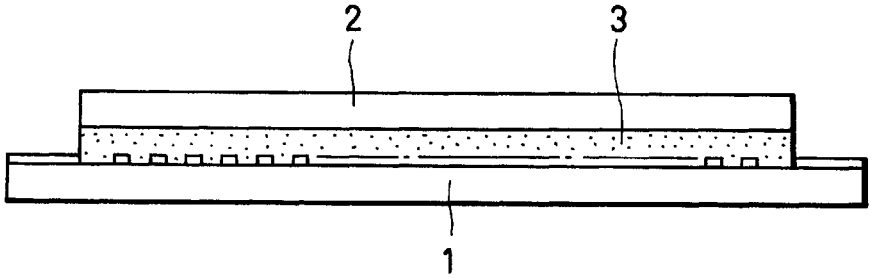
FIG. 16 is a side view of the planar type plasma discharge display device according to the embodiment of the present invention.

In each example, the planar type plasma display device is of the AC drive type. As shown by a plan view of FIG. 15 and by a side view of FIG. 16, there is formed a planar type display receptacle in which a first substrate 1 and a second substrate 2 at least one of which is capable of passing display light and each made of a transparent glass substrate, are opposed with a predetermined interval, the peripheral portions of the first and second substrates are sealed airtight by a seal material 3 such as glass frit or the like and a flat gas space is formed between the two substrates 1 and 2.

The first substrate 1 has an area larger than that of the second substrate 2, and its side edge portions, i.e. four side edge portions in the illustrated example are outwardly exposed from the respective side edge portions of the second substrate 2.

Figure 17:
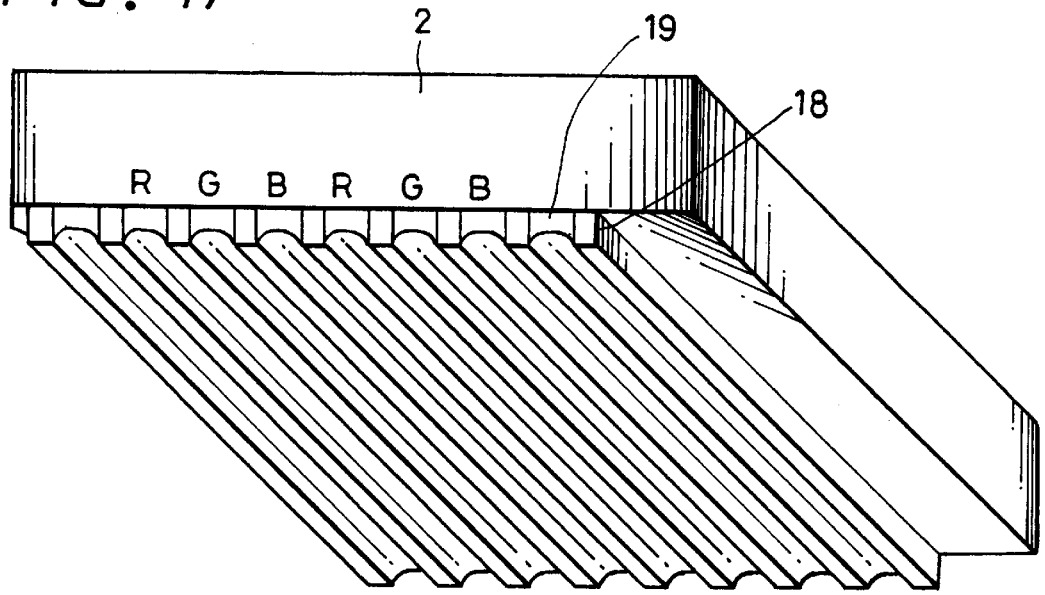
FIG. 17 is a fragmentary cross-sectional perspective view and side view of the planar type plasma discharge display device according to the embodiment of the present invention.
Figure 17:
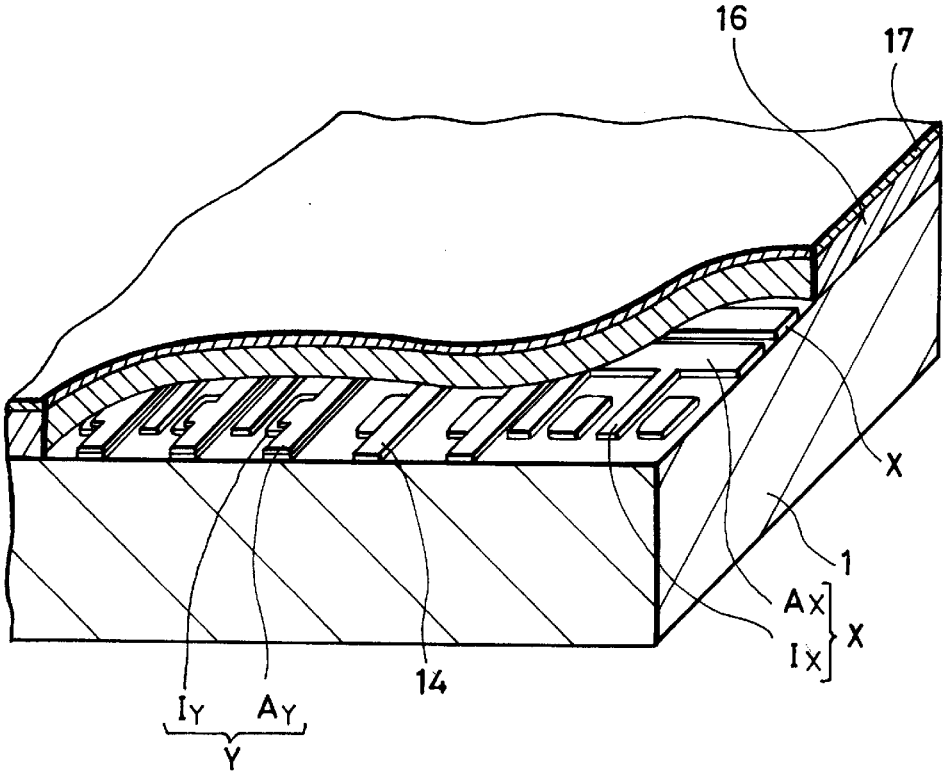

FIG. 17 is a perspective view showing a main portion of the inside of the disassembled first and second substrates 1 and 2.

On the inner surface of the first substrate 1, i.e. on the surface opposing the second substrate 2, there are formed a first electrode group 11 in which a plurality of electrode elements (referred to as row electrode elements for convenience sake) X extended in the first direction are arrayed and a second electrode group 12 in which a plurality of electrode elements (referred to as column electrode elements for convenience sake) Y extended in the direction crossing, e.g. perpendicular to the first direction.

Figure 18A:
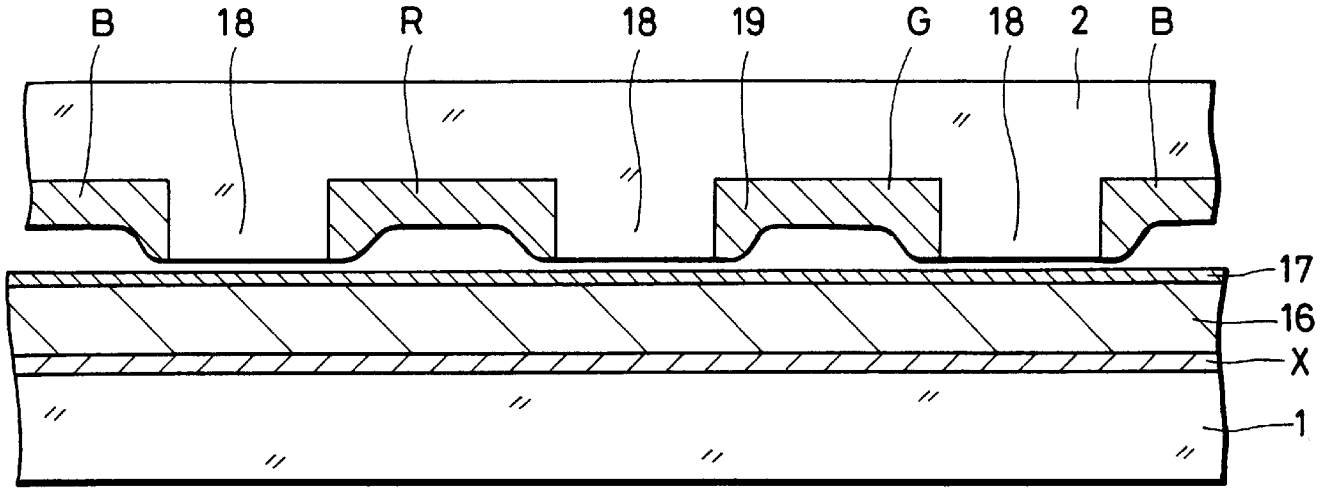
FIG. 18A is a fragmentary cross-sectional view of the planar type plasma discharge display device according to the embodiment of the present invention.
Figure 18B:
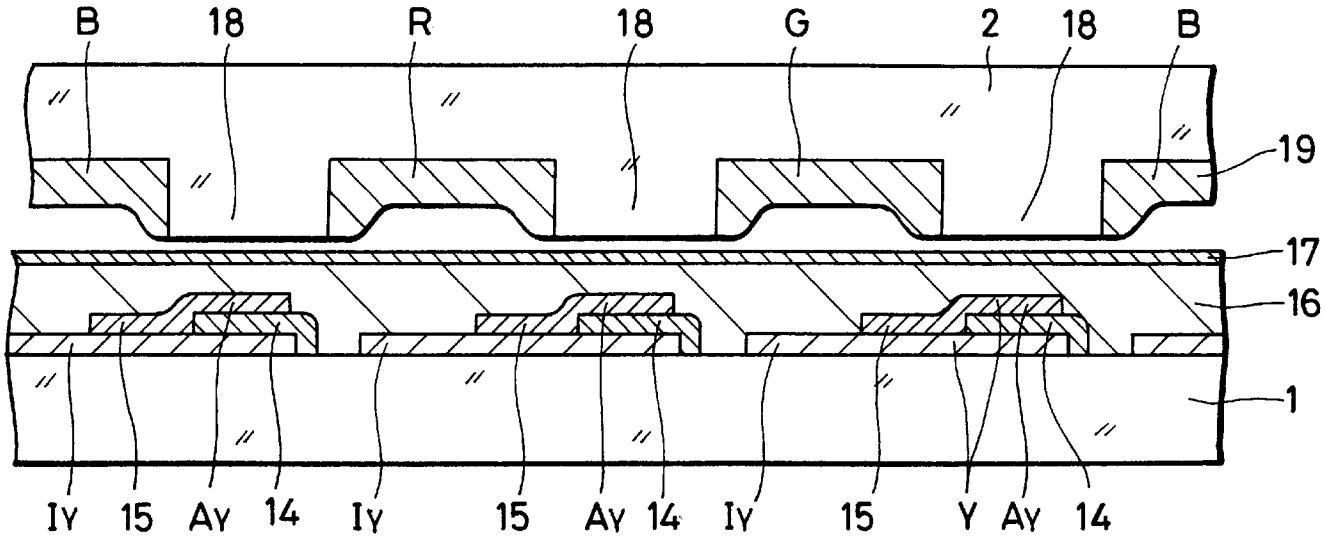
FIG. 18B is a fragmentary cross-sectional view taken along other surface of the planar type plasma discharge display device according to the embodiment of the present invention.
Figure 19:
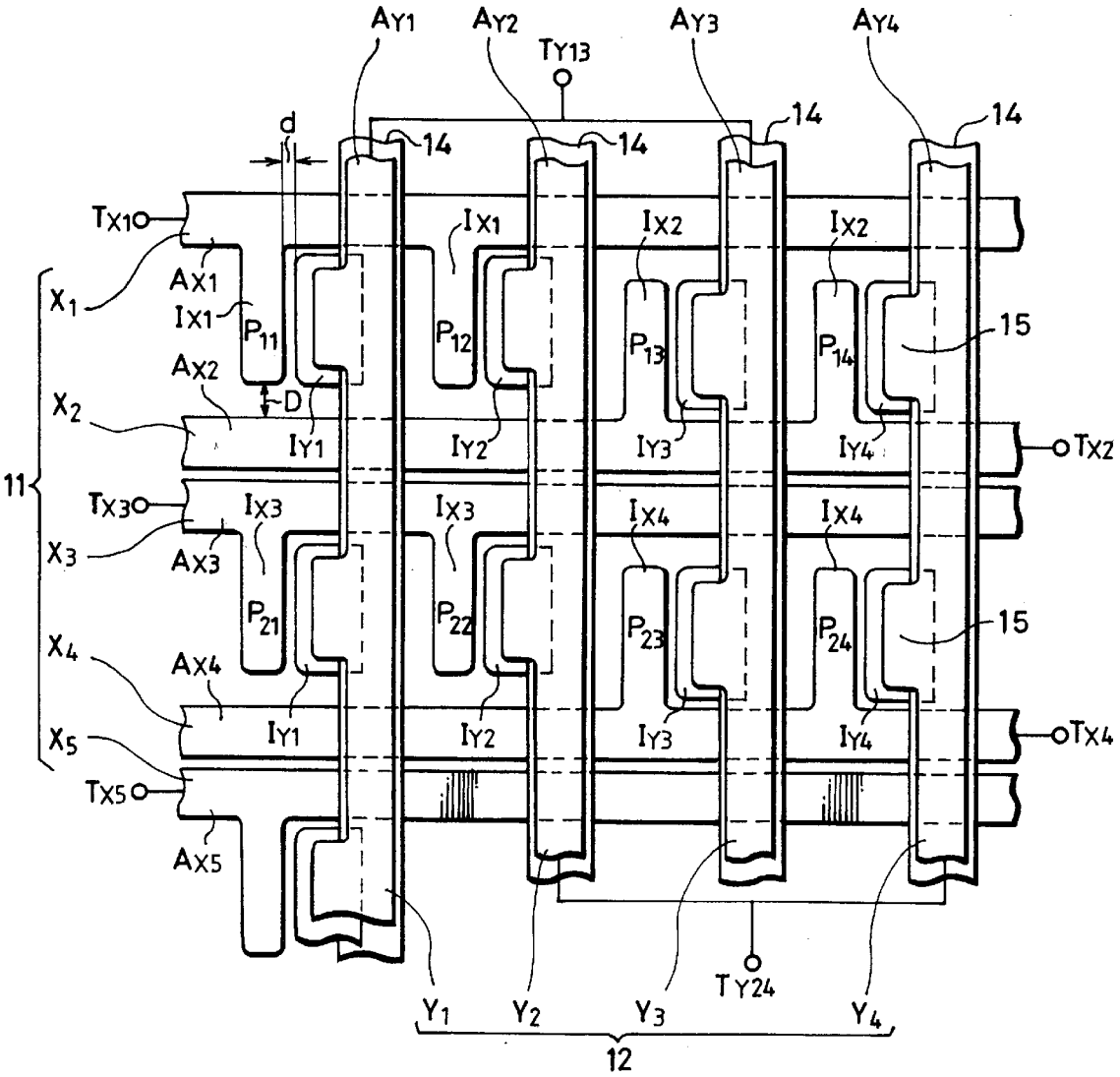
FIG. 19 is a pattern diagram of an example of a device according to the present invention.

FIG. 18A shows a cross-sectional view taken along the row direction of the row electrode element X of an example of the above-mentioned device according to the present invention. FIG. 18B shows a cross-sectional view taken along the similar row direction in the row electrode elements X. FIG. 19 shows a pattern diagram of an example of the first and second electrode groups 11 and 12 formed on the first substrate 1.

In this example, the respective electrode elements X ($X_1$, $X_2$, $X_3$ . . . ) and Y ($Y_1$, $Y_2$, $Y_3$ . . . ) of the first electrode group 11 and the second electrode group 12 are both extended in the first direction comprising the feeding portion and the second direction perpendicular to the first direction, band-like electrode portions $A_X$ ($A_{X1}$, $A_{X2}$, $A_{X3}$ . . . ) and $A_Y$ ($A_{Y1}$, $A_{Y2}$, $A_{Y3}$ . . . ) arrayed in parallel to each other and discharge electrode segments $I_X$ ($I_{X1}$, $I_{X2}$, $I_{X3}$ . . . ) and $I_Y$ ($I_{Y1}$, $I_{Y2}$, $I_{Y3}$ . . . ) electrically extended from the respective band-like electrode portions $A_X$ and $A_Y$.

The respective electrode portions $A_X$ of the respective electrode elements X of the first electrode group 11 may form respective row electrode terminals $T_X$ ($T_{X1}$, $T_{X2}$, $T_{X3}$ . . . ) by extending respective end portions thereof to the side edge portion of the first substrate 1 until they are exposed to the outside.

An insulating layer 14 made of $SiO_2$, for example, is deposited on the lower surface of the band-like electrode portion $A_Y$ of the column electrode elements Y. This insulating layer 14 is interposed at the crossing portions of the respective column electrode elements Y ($Y_1$, $Y_2$, $Y_3$ . . . ) and the respective row electrode elements X ($X_1$, $X_2$, $X_3$ . . . ), thereby electrically insulating the column electrode elements Y and the row electrode elements X from each other.

Figure 20:
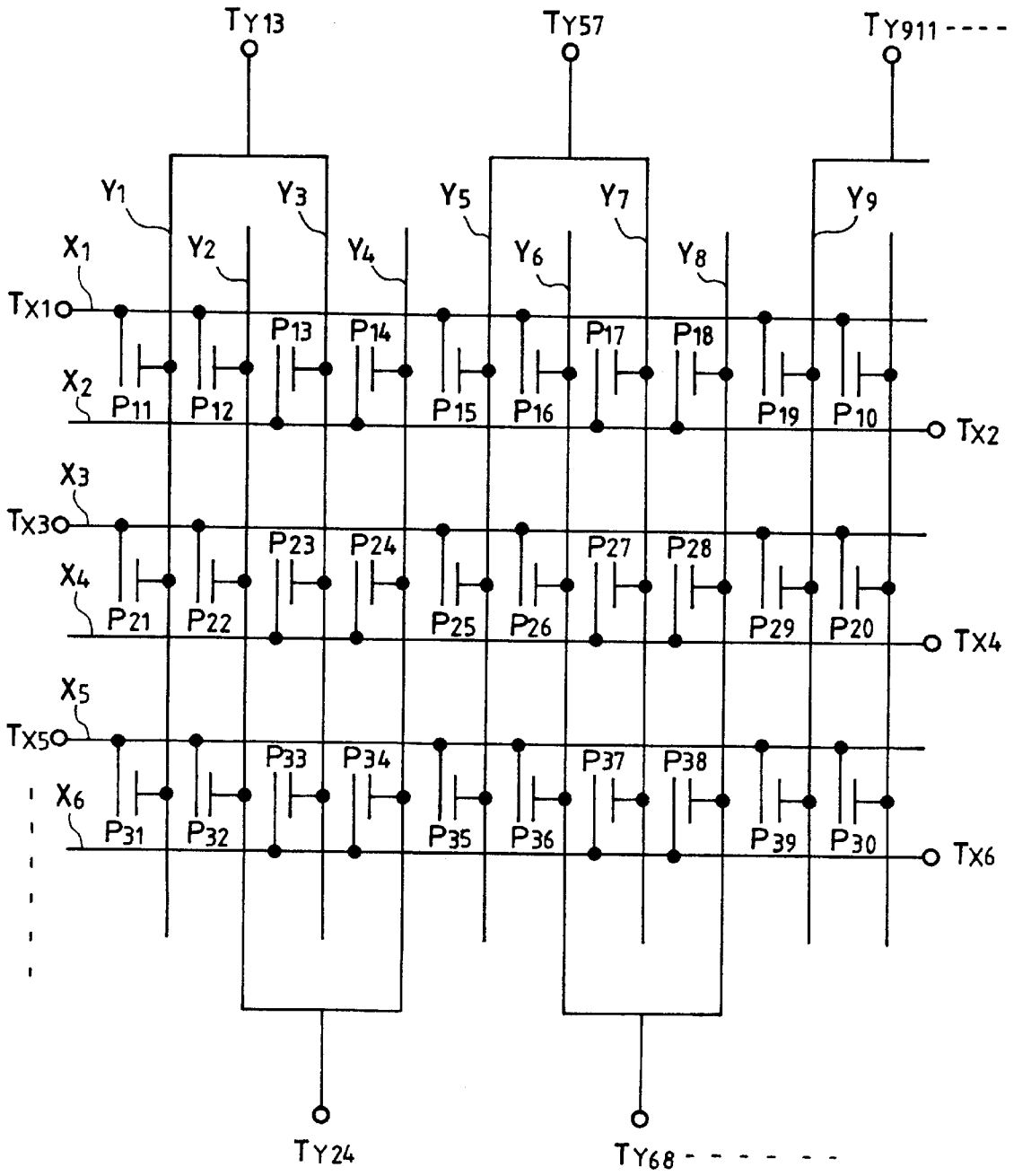
FIG. 20 is a diagram showing an electrical interconnection of an example of the device according to the present invention.

The respective electrode elements X and Y of the first and second electrode groups 11 and 12 comprise plasma discharge portions arrayed in a matrix-fashion. FIG. 20 shows an example of an interconnection of the respective electrode elements X ($X_1$, $X_2$, $X_3$ . . . ) and Y ($Y_1$, $Y_2$, $Y_3$ . . . ). As illustrated, the electrode elements Y of the second electrode group 12 form adjacent four electrode elements into one set, connect every other electrode elements $Y_1$ and $Y_3$, $Y_2$ and $Y_4$ . . . in each set to each other and extend the same to other side edge portion of the first substrate 1 to the outside, thereby leading out the respective electrode terminals $T_Y$ ($T_{Y13}$, $T_{Y24}$, $T_{57}$ . . . ).

Then, in response to the respective crossing portions of every other electrode elements $X_1$, $X_3$, $X_5$ . . . of the first electrode group 11 and corresponding adjacent two electrode elements $Y_1$ and $Y_2$, $Y_5$ and $Y_6$, $Y_9$ and $Y_{10}$ . . . in each set of the second electrode group 12, there are formed plasma discharge portions $P_{11}$ and $P_{12}$, $P_{21}$ and $P_{22}$, $P_{31}$ and $P_{32}$, . . . , $P_{15}$ and $P_{16}$, $P_{25}$ and $P_{26}$, $P_{35}$ and $P_{36}$ . . . , $P_{19}$ and $P_{10}$, $P_{29}$ and $P_{20}$, $P_{39}$ and $P_{30}$, . . . In response to the respective crossing portions of every other electrode elements $X_2$, $X_4$, $X_6$ . . . of other first electrode group 11 and corresponding adjacent other two electrode elements $Y_3$ and $Y_4$, $Y_7$ and $Y_8$, $Y_{11}$ and $Y_{12}$ . . . of each set of the second electrode group 12, there are formed plasma discharge portions $P_{13}$ and $P_{14}$, $P_{23}$ and $P_{24}$, $P_{33}$ and $P_{34}$, . . . , $P_{17}$ and $P_{18}$, $P_{27}$ and $P_{28}$, $P_{37}$ and $P_{38}$ . . .

When these plasma discharge portions P ($P_{11}$, $P_{12}$, $P_{21}$, $P_{22}$, $P_{31}$, $P_{32}$, . . . , $P_{15}$, $P_{16}$, $P_{25}$, $P_{26}$, $P_{35}$, $P_{36}$ . . . ) are formed, in the portion in which these plasma discharge portions P are formed, they are formed by the aforementioned respective discharge electrode portions $I_X$ and $I_Y$ of the corresponding electrode elements X and Y.

To be concrete, as shown in FIG. 19, for example, every other electrode elements $X_1$, $X_3$, $X_5$ . . . are opposed to corresponding adjacent electrodes $Y_1$ and $Y_2$ in each set of the Y electrodes, the discharge electrode segments $I_{Y1}$, $I_{Y2}$ of the corresponding adjacent electrodes $Y_5$ and $Y_6$ not shown in FIG. 19 and the discharge electrode segments $I_{Y5}$, $I_{Y6}$ not shown in FIG. 19 with a distance d. Then, every other electrode elements $X_2$, $X_4$, $X_6$ . . . are opposed to other corresponding adjacent electrodes $Y_3$ and $Y_4$ in each set of the Y electrodes, discharge electrode segments $I_{Y3}$, $I_{Y4}$ of other corresponding adjacent electrodes $Y_7$ and $Y_8$ . . . not shown in FIG. 19 and discharge electrode segments $I_{Y7}$, $I_{Y8}$ not shown in FIG. 19 with the interval d. Then, an electrode element interval D other than the portions in which the discharge opposing electrodes are formed is selected to be larger than the distance d.

The respective electrode elements X of the first electrode group 11 may be formed by the same conductive layer as a pattern in which the electrode portions $A_X$ and the discharge electrode segments $I_X$ are made continuous. Further, by these electrode elements X and the same conductive layer, i.e., at the same time the electrode elements X are formed, the discharge electrode segment $I_Y$ of the second electrode elements Y may be formed by the same conductive layer.

In this case, the so-called feeding electrode portion $A_Y$ of each electrode element Y is formed across the electrode portion $A_X$ of the electrode element X through the insulating layer 14 such as $SiO_2$ or the like by a conductive layer different from that of the discharge electrode segment IY of the above-mentioned electrode elements X and Y.

Then, the discharge electrode segments IY of these respective electrode elements Y and the above-mentioned respective discharge electrode segments $I_Y$ are electrically connected to each other by connection pieces 15 which are formed integral with and extended from each corresponding electrode portion $A_Y$ to each discharge electrode segment $I_Y$.

In the example shown in FIG. 19, the discharge electrode segment $I_X$ of each electrode element X is shaped as an I-letter extended in the direction perpendicular to each band-shaped electrode portion $A_X$, and the discharge electrode segment $I_Y$ of each electrode element Y is opposed to one side surface of the above discharge electrode segment with the distance d, thereby resulting in the plasma discharge portion P being formed. However, the respective discharge electrode segments $I_X$ and $I_Y$ are not limited to these patterns, and may be shaped variously. In order to extend the opposing length, as shown in FIG. 21, the pattern of the discharge electrode segment $I_Y$ of the electrode element Y may be formed as a concave-shape so as to surround the I-shaped discharge electrode segment $I_X$ of the electrode element X, for example.

Figure 22:
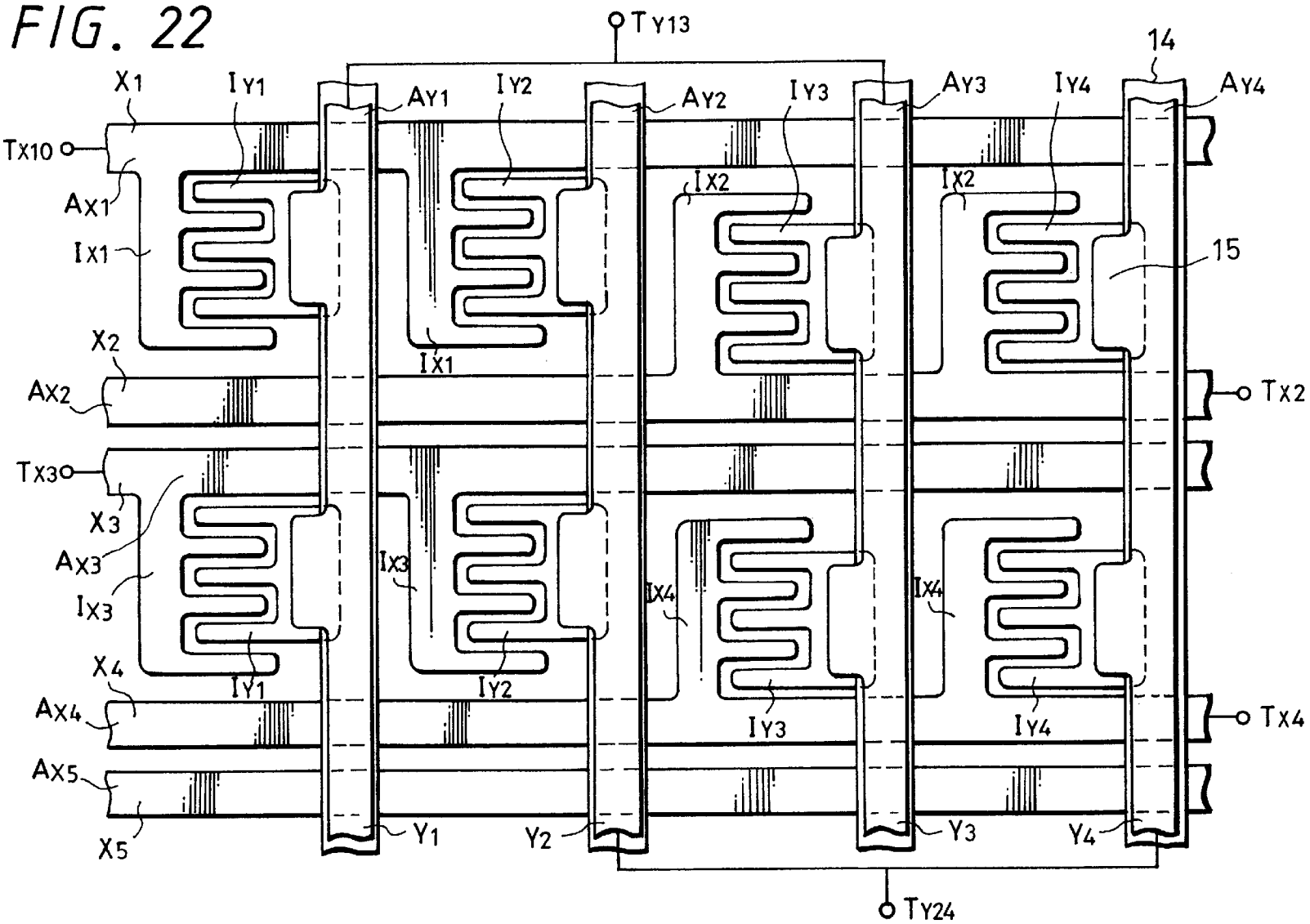
FIG. 22 is a pattern diagram of other example of the device according to the present invention.

Alternatively, as shown in FIG. 22 which shows a pattern diagram of an example, there may be used a variety of patterns such as when the opposing portions of the discharge electrode segments $I_X$ and $I_Y$ of the respective electrode elements X and Y of the first and second electrode groups 11 and 12 are shaped as zigzag patterns.

Figure 21:
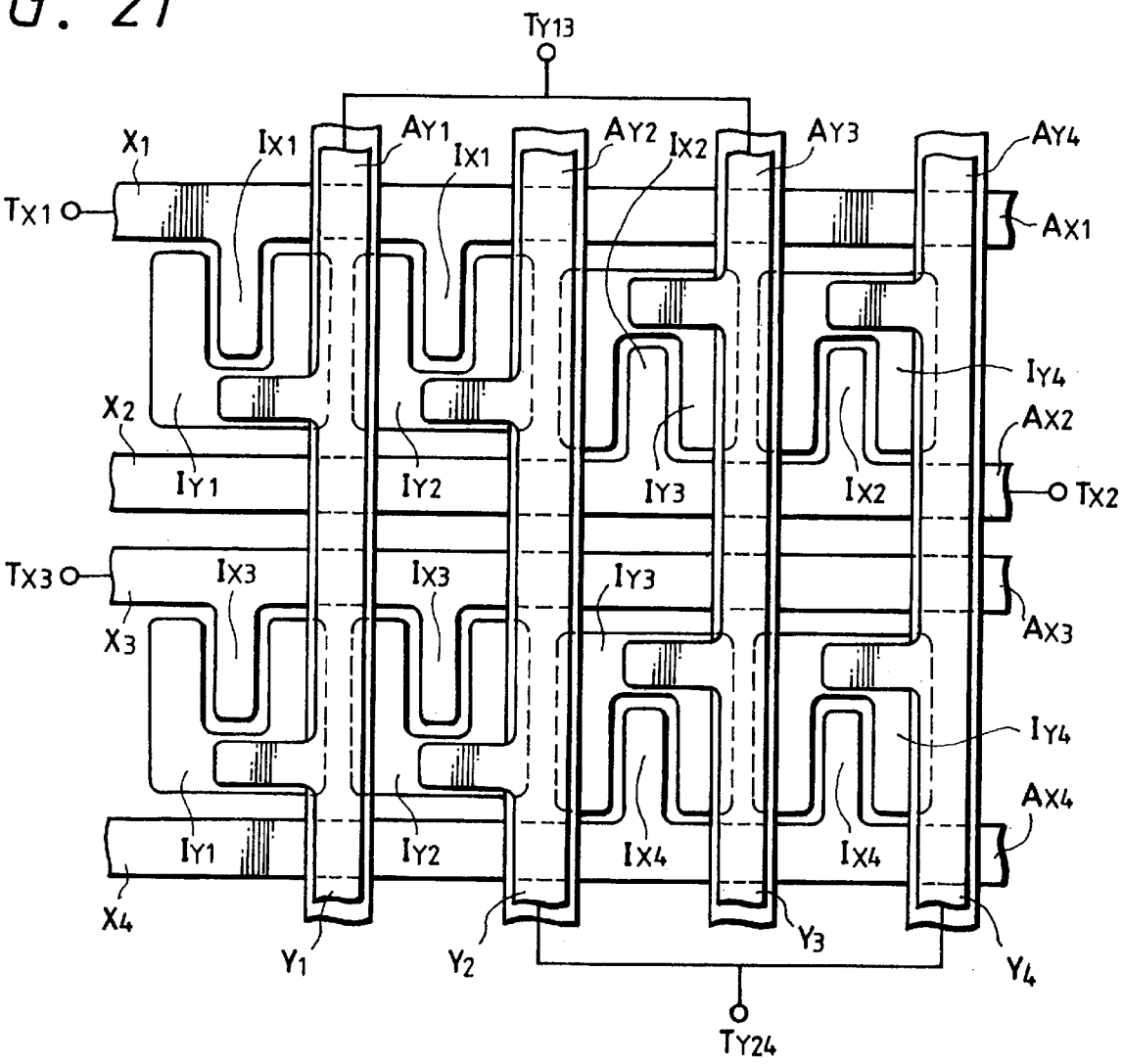
FIG. 21 is a pattern diagram of other example of the device according to the present invention.

In FIGS. 21 and 22, elements and parts corresponding to those of FIG. 5 are marked with the same reference numerals and an overlapping explanation will be omitted.

Figure 23:
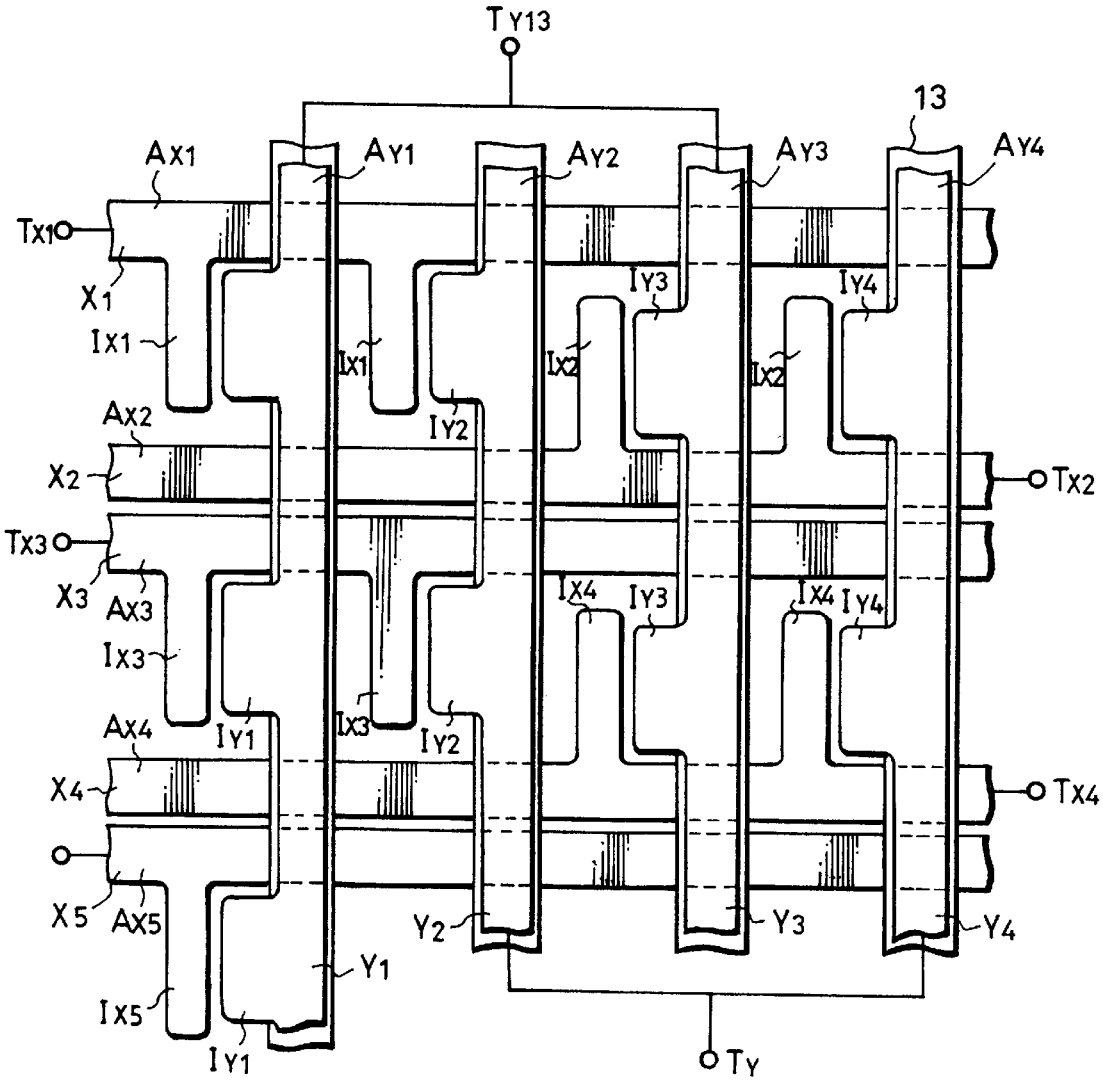
FIG. 23 is a pattern diagram of other example of the device according to the present invention.
Figure 24:
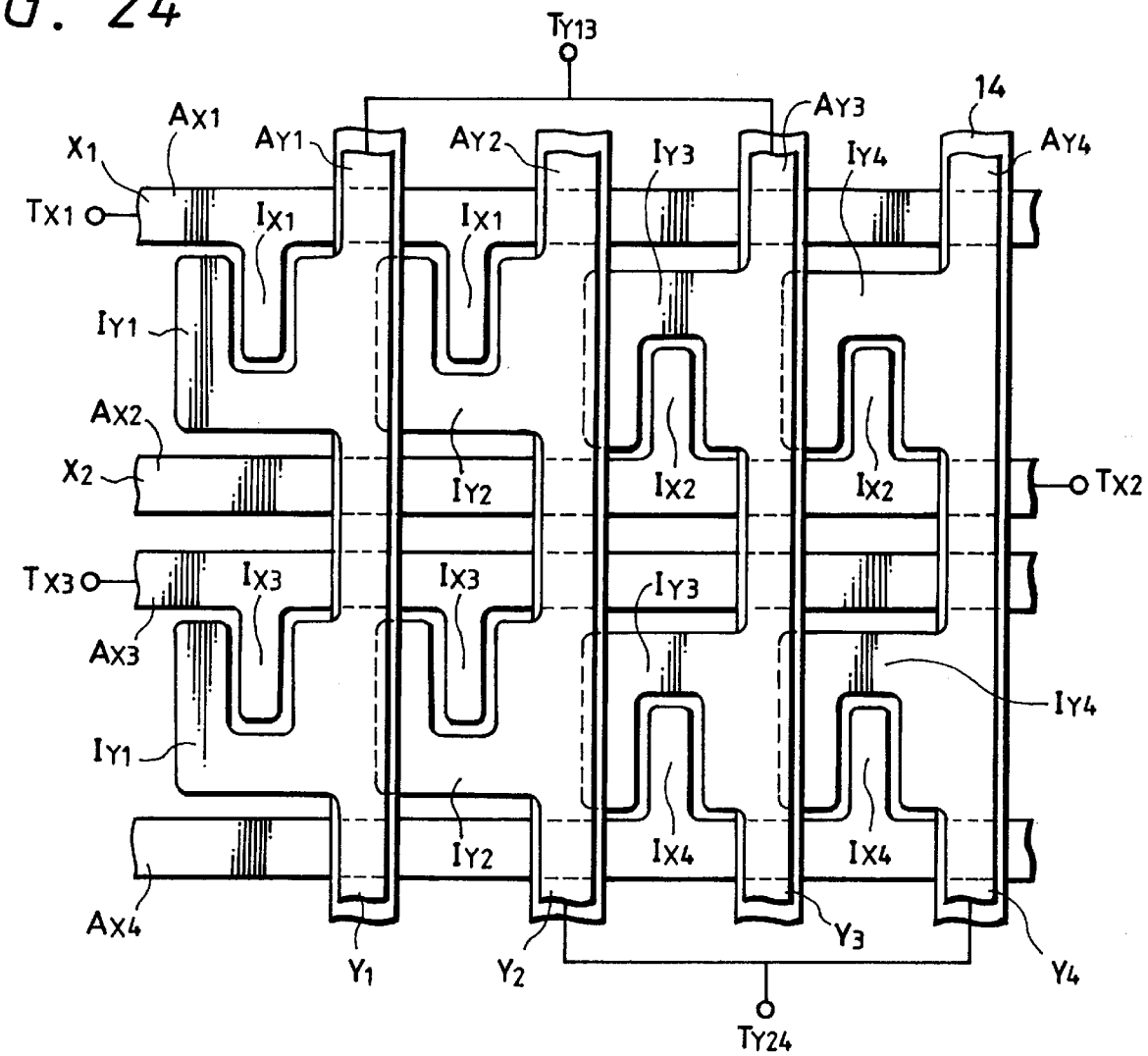
FIG. 24 is a pattern diagram of other example of the device according to the present invention.
Figure 25:
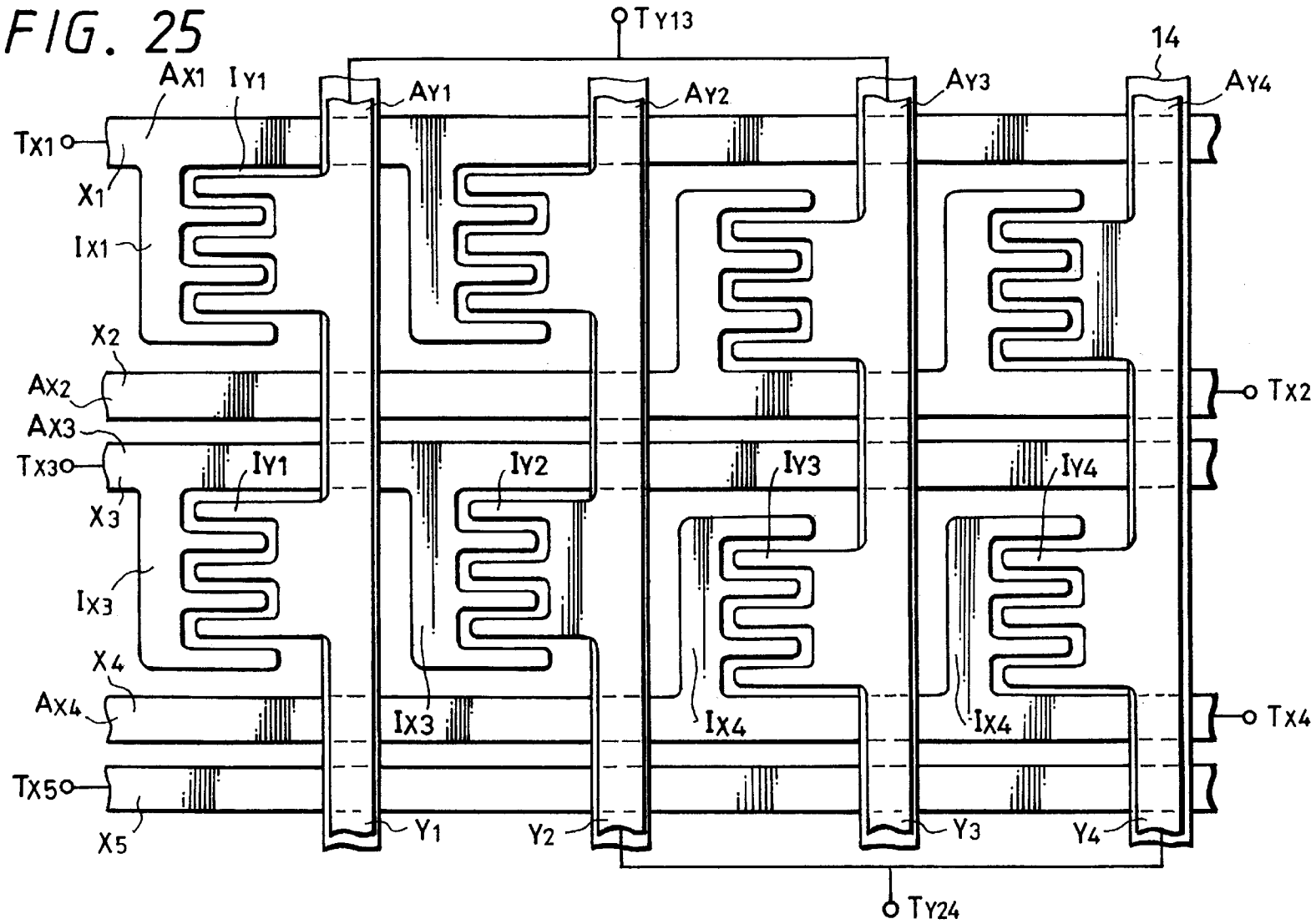
FIG. 25 is a pattern diagram of other example of the device according to the present invention.

In the above-mentioned examples, the electrode elements X of the first electrode group 11 and the discharge electrode segments $I_X$ of the electrode elements Y of the second electrode group 12 may be formed of the same conductive layer. In this case, the distance d between the two electrode elements X and Y can be set accurately. In some cases, as shown in FIGS. 23, 24 and 25, the discharge electrode segments $I_Y$ and the feeding electrode portions $A_Y$ of the electrode elements Y may be formed of the same conductive layer simultaneously. That is, in this case, the electrode elements X and the electrode elements Y are formed by different processes. According to this arrangement, since the above-mentioned connection pieces 15 may be excluded, the pattern may be microminiaturized, i.e. the plasma discharge portion P may be made in high-density. In FIGS. 23, 24 and 25, the patterns of the respective discharge electrode segments $I_X$ and $I_Y$ are shaped similarly to those of FIGS. 19, 21 and 22. In FIGS. 23, 24 and 25, elements and parts corresponding to those of FIGS. 19, 21 and 22 are marked with the same reference numerals, and an overlapping explanation will be omitted.

In the above-mentioned examples, the discharge electrode segments $A_X$ and $A_Y$ are provided on the respective electrode elements X and Y. With respect to the electrode elements X, for example, the discharge electrode segments $A_X$ need not be provided, and the discharge electrode segments $A_Y$ of the electrode element Y may be extended to the opposing position with the distance d to the side surface of the corresponding electrode portion $I_X$, thereby resulting in the plasma discharge portion P being formed.

A dielectric layer 16 such as $SiO_2$ or the like is deposited on the whole surface of the first substrate 1 so as to cover the portions in which the first and second electrode groups are formed except each row electrode terminal $T_X$ and each column electrode terminal $T_Y$. On the dielectric layer, there is deposited a surface layer 17 made of MgO, for example, having a work function smaller than that of the dielectric layer 16 and which has an effect for protecting the dielectric layer 16 from being damaged by plasma discharge, if necessary.

Although the surface layer 17 made of MgO or the like may be removed from the band-shaped electrode portion $A_Y$ extending in the column direction of the column electrode Y, if the surface layer is deposited on the whole surface of the dielectric layer 16, then a manufacturing process may be advantageously simplified.

On the other hand, on the inner surface of the second substrate 2, i.e. on the surface of the side opposing the first substrate 1, as shown in FIG. 17 and FIG. 18 there are protruded band-like partitions 18 extended in the column direction in an opposing relation to the band-like electrode portions $A_Y$ ($A_{Y1}$, $A_{Y2}$, $A_{Y3}$ . . . ) extended in the column direction of the column electrode element, i.e. the electrode element Y of the second electrode group 12. The height of this partition 18 is selected in such a manner that an interval between the partition 18 and the dielectric layer 16 or the surface layer 17 formed on the surface of the dielectric layer may not produce plasma discharge which will be described later on.

A fluorescent layer 19 on which fluorescent materials R, G and B for emitting light of red, green and blue colors, for example, are alternately coated in a stripe shape is formed between the respective partitions 18 on the inner surface of the second substrate 2. Each fluorescent material is coated on the side surface and the bottom surface of the partition 18, i.e. over the portions opposing the electrode elements X and Y as shown in FIGS. 17 and 18. That is, the fluorescent material may be formed in a wide area.

A gas is sealed into a flat space formed between the first and second substrates 1 and 2. As this gas sealed into the flat space, there is mainly used a mixed gas of more than one kind of, for example, He, Ne, Ar, Xe, Kr, e.g. a so-called Penning gas of a mixed gas of Ne and Xe or a mixed gas of Ar and Xe.

This sealed gas pressure P may be selected in a range of from 0.3 to 5.0 atm, for example.

Then, when a discharge start voltage $V_S$ is selected to be a predetermined voltage, e.g. Paschen minimum value, from Paschen's law, the sealed gas pressure P is selected such that a product P (d of this sealed gas pressure P and a distance between the discharge portions of the electrode elements X and Y, i.e. in the above-mentioned illustrated examples, distance d between the respective discharge electrode segments $I_X$ and $I_Y$ which are opposed to each other becomes constant. However, when the discharge start voltage $V_S$ is selected to be Paschen minimum value, for example, the discharge electrode distance d may allow a fluctuation of (several tens of percents relative to the distance d which is determined at that time. Also, when the discharge start voltage $V_S$ is selected to be other values than the Paschen minimum value, the above-mentioned discharge electrode distance d may have an allowance of approximately 30% relative to the discharge electrode distance which is determined at that time.

Then, the discharge electrode distance d may be selected to be a narrow interval such as under 50 $\mu$m, e.g. 5 to 20 $\mu$m, further under 5 $\mu$m and 1 $\mu$m or the like.

Figure 26A:
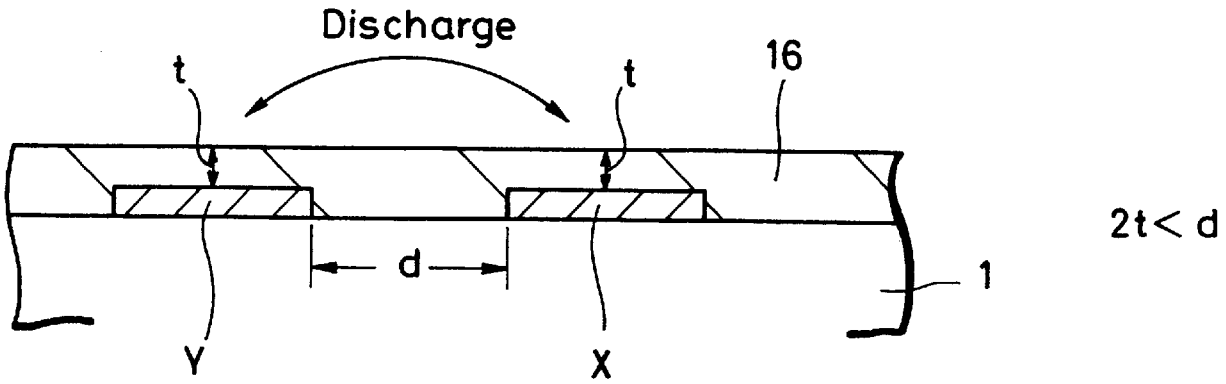
FIGS. 26A and 26B are each a diagram used to explain the manner in which a distance between discharge electrodes is selected.
Figure 26B:
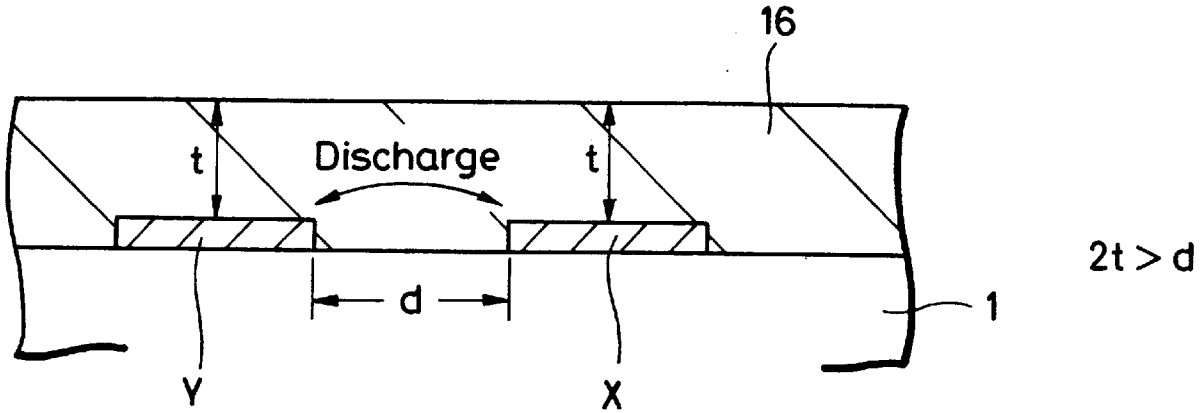

On the other hand, this discharge electrode distance d has to be selected in relation to a thickness t of the dielectric layer 16. That is, as shown by the discharge mode in FIG. 26A, in order to produce plasma discharge above the dielectric layer 16, the discharge has to be produced through the thickness direction of the dielectric layer 16. As shown in FIG. 26B, it is necessary to avoid that the discharge is produced between the two electrode elements X and Y in the dielectric layer 16, i.e. in the above-mentioned example, between the discharge electrode segment $I_X$ and the opposing discharge electrode segment $I_Y$. To this end, if a permittivity of the surface layer 17 is sufficiently lower than that of the dielectric layer 16, then it is desired that a relationship between the distance and the thickness may satisfy 2t<d.

Then, a distance D between electrodes which do not comprise a pair of discharge electrodes obtained other than the opposing portions of the row electrode elements X and the discharge electrode segments $I_Y$ ($I_{Y11}$, $I_{Y12}$, $I_{Y13}$ . . . , $I_{Y21}$, $I_{Y22}$, $I_{Y23}$ . . . , $I_{Y31}$, $I_{Y32}$, $I_{Y33}$ . . . ) of the electrode elements Y which become opposing electrodes comprising each pair of discharge electrodes is selected to be sufficiently larger than the discharge electrode distance d, i.e. D>>d.

Next, an operation of the thus arranged display device will be described. In this display device, plasma discharge may be produced in the gas space between the second substrate 2 and the pair of discharge electrodes applied with the voltage on the dielectric layer 16 (on the surface layer if the surface layer 17 is formed on the dielectric layer) by applying an AC voltage higher than the discharge start voltage to the portion between the predetermined, e.g. the selected terminals $T_X$ and $T_Y$ of the first and second electrode groups 11 and 12 forming the pair of discharge electrodes.

That is, in this case, the portions opposing the discharge electrode segment $I_Y$ of each column electrode element Y relative to each row electrode element X with the distance d and the nearby portion thereof become a unit discharge region.

Then, when plasma discharge is produced as described above, the fluorescent materials R, G, B disposed in the discharge space of this unit discharge region are excited to emit light by resultant ultraviolet rays, for example.

By applying a predetermined voltage to the row electrode elements $X_1$, $X_2$, $X_3$ . . . in a time-division manner and applying the discharge start voltage to the respective column electrode elements $Y_1$, $Y_2$, $Y_3$ . . . in response to display information in synchronism therewith, plasma discharge may be produced in the unit discharge region corresponding to target display information to excite the fluorescent materials R, G, B, thereby resulting in one pixel of adjacent fluorescent materials R, G, B, i.e. one color picture element being displayed.

In this case, the column direction of each unit discharge region is restricted by the voltage applied to the row electrode elements $X_1$, $X_2$, $X_3$ . . . , and the row direction thereof is restricted when the occurrence of plasma discharge is restricted by the existence of the partition 18, thereby avoiding the cross-talk from being caused.

The light emission and display produced by the planar type plasma discharge display device according to the present invention may be observed from the first substrate 1 side or the second substrate 2 side. In this case, at least the substrate 1 or 2 from which the light emission and display may be observed is formed of the transparent substrate for passing display light, e.g. glass substrate as mentioned before. When the two substrates 1 and 2 are formed of the transparent substrate, if a light reflecting film or light shielding film (not shown) such as an Al vapor-deposition film or the like is formed on the inner surface of the substrate 2 or 1 on the side opposite to the observation side before each electrode group or the fluorescent layer is formed, then emitted light may be effectively introduced into the observation side, and external incident light from the back surface side may be shielded, thereby making it possible to increase a contrast.

When the light emission and display are observed from the first substrate 1 side in which the electrode groups are formed, the respective electrode elements of the first and second electrode groups 11 and 12 are formed of transparent conductive layers, e.g. ITO (composite oxide of In and Sn).

An example of a manufacturing method of a display device according to the present invention will be described next. In this example, the row electrode elements X and the discharge electrode segments IY of the column electrode elements Y are formed of the same conductive layer, i.e. by the same process.

Initially, a manufacturing process concerning the first substrate 1 will be described. The first substrate 1 is formed of a glass substrate, for example. A photo resist layer is coated on the whole surface of its major surface, and this resist layer is treated by patterning. In this patterning process, the photo resist layer is removed from the portions, in which each electrode element X of the first electrode group 11 and the discharge electrode segment $I_Y$ of the electrode element Y of the second electrode group 12 finally formed are formed, by pattern-exposing and developing the photo resist layer.

Then, a conductive layer comprising each electrode element X of the first electrode group 11 and the discharge electrode segment IY of each electrode element Y of the second electrode group 12 is deposited on the whole surface of the first substrate 1 including the removed portion of the photo resist layer by vapor deposition, for example.

This conductive layer may be formed of an ITO of a transparent conductive layer, for example, and a metal layer of more than one kind of Al, Cu, Ni, Fe, Cr, Zn, Au, Ag, Pb and so on or a laminated layer structure of Cr/Al having an Al layer and a surface layer such as a Cr layer or the like formed thereon to block the Al from being oxidized or a conductive layer of a multilayer structure of Cr/Al/Cr having an underlayer formed of a Cr layer, for example, having an excellent deposition property relative to the glass substrate, for example.

Next, the photo resist layer is stripped by a stripper, the conductive layer formed on the photo resist layer is removed together with the photo resist layer, i.e. lifted off, thereby the conductive layer being patterned.

In this manner, the conductive layer is patterned, and only each electrode element X of the first electrode group 11 and the discharge electrode segment $I_Y$ of each electrode element Y of the second electrode group 12 are formed as shown in FIGS. 19, 21 and 22, for example.

Then, there is formed the insulating layer 14. When this insulating layer 14 is formed, for example, a photosensitive glass paste forming the insulating layer is coated on the whole surface of the first substrate 11 on which there are formed each electrode element X and the discharge electrode segment IY of each electrode element Y of the second electrode group 12, and heat-treated at 80° C. for 20 minutes. Thereafter, by pattern-exposing and developing this glass layer, a band-like pattern crossing the respective electrode elements X is formed across the electrode elements X under the portion in which the electrode portions $A_Y$ of the respective electrode elements Y are formed. Thereafter, a product is fired at 600° C. In this manner, there may be formed the insulating layer 14.

Then, as shown in FIGS. 19, 21 and 22, there are formed the electrode portions $A_Y$ of the electrode elements Y and the connection pieces 15 extended from the electrode portions. When they are formed, also they may be formed by lift off method. That is, also in this case, a photo resist layer is coated on the whole surface of the first substrate 1 and the photo resist is treated by patterning according to pattern exposure and development. Thereafter, a conductive layer made of Al, for example, is deposited on the whole surface by vapor deposition, the photo resist layer is stripped, the conductive layer is removed together with the photo resist layer formed on the conductive layer by lift off, whereby the electrode portions $A_Y$ of the second electrode group 12 and the connection pieces 15 extended from the above electrode portions are formed simultaneously.

In this manner, the first and second electrode groups 11 and 12 are formed.

Thereafter, the dielectric layer 16 such as $SiO_2$ or the like is deposited on the whole surface except the terminal leading-out portion of the terminals $T_X$ and $T_Y$ formed by the end portions of the respective electrode elements X and Y, for example, i.e. outer peripheral portion of the substrate 1 by a CVD (chemical vapor deposition) method or the like. The surface layer 17 such as MgO or the like is deposited on the dielectric layer by the vapor deposition, for example.

A manufacturing process concerning the second substrate 2 will be described next. Also in this case, there is prepared the second substrate 2 formed of the glass substrate, for example. The aforementioned partition 18 is formed on one major surface of the second substrate. To this end, initially, a photo resist layer, for example, is coated on the whole surface of the substrate 2 at its surface on which the partition 18 is formed or a laminate glass material sheet, for example, a GREEN SHEET (trade name manufactured by The Du Pont Company) is bonded to the whole surface of the substrate on its surface in which the partition is formed, and pre-baked at 210° C. or 410° C.

Thereafter, a photo resist layer is coated, and the photo resist layer is removed from other portions than the portion in which the partition 18 is formed, i.e. the photo resist layer is left in the pattern of the partition 18.

Then, this photo resist layer is used as a mask, and other portions are removed by powder beam process or so-called sand blast while the portion in which the photo resist layer is formed is left.

Thereafter, the product is sintered at 600° C., for example. If so, the photo resist layer is vanished, and the partition 18 made of the glass material is formed.

On the inner surface of the second substrate 2 in which the stripe-shaped partition 18 was formed in this manner, there are formed red, green and blue fluorescent materials R, G and B at every two concave portions between the partitions 18 by sequentially coating fluorescent slurries. Then, the fluorescent layer 19 is formed by firing the product at 430° C., for example.

The first substrate 1 in which the first and second electrode groups 11 and 12 are formed and the second substrate 2 in which the partition 18 and the fluorescent layer 19 are formed as described above are opposed to each other with a predetermined interval under the condition that the respective electrode portions $A_Y$ of each electrode element Y of the second electrode group 12 are faced to the respective partitions 18 of the second substrate 2, and their peripheral portions are sealed with glass frit by heat treatment at 430° C., for example.

The frit position in this case is selected to be the position from which the terminal portions $T_X$ and $T_Y$ of each electrode element are led out to the outside.

The flat space formed between the first and second substrates 1 and 2 as described above is evacuated for two hours under the condition that it is heated at 380° C., for example. Then, the aforementioned gas is sealed into this flat space at a predetermined gas pressure. In this manner, there is arranged a planar type plasma discharge display device according to the present invention.

Incidentally, when the insulating layer 14 is formed under the electrode portion $A_Y$ of the electrode element Y, for example, by heat treatment at a high temperature such as firing at 600(C, if the conductive layer formed before this heat treatment, i.e. in the above-mentioned example, each electrode element X of the first electrode group 11 and each discharge electrode segment $I_Y$ of each electrode element Y of the second electrode group 12 are made of Al, for example, there is then the problem that disadvantages of deterioration of characteristics such as the oxidization of Al occur. In this case, as described before, it is desired that this conductive layer should be formed as a multilayer structure in which Cr forming a bad conductor layer for protecting Al and which is stable against the oxidization is formed on the aluminum.

While the respective electrode groups 11 and 12 are formed by the lift off according to the above-mentioned method, the respective electrode groups may be formed by pattern-etching a conductive layer with photolithography after the conductive layer was formed on the whole surface. Thus, the method of the present invention is not limited to the above-mentioned example, and various methods may be applied.

While the electrode elements X of the first electrode group 11 and the discharge electrode segments $I_Y$ of the electrode elements Y of the second electrode group 12 are formed by the same conductive layer through the same process as described above, the discharge electrode segments $I_Y$ of the electrode elements Y of the second electrode group 12 and the so-called feeding electrode portions $A_Y$ may be composed of the same conductive layer by processes different from those of the first electrode group 11. That is, in this case, after only the electrode elements X were formed, the insulating layer 14 is formed as described above, and then the electrode portions $A_Y$ of the electrode element Y and the discharge electrode portions $I_Y$ extended from the above electrode portion may be formed. In this case, as shown in FIGS. 23, 24 and 25, the process for forming the connection piece 15 is omitted.

While the insulating layer 14 and the dielectric layer 16 are formed respectively in the above-mentioned example, these layers may be formed of the same material layer such as $SiO_2$, glass layer or the like. In this case, when the aforementioned insulating layer 14 is formed, this insulating layer is not patterned but formed on the whole surface, whereby contact holes are formed through the overlapping portions of the respective discharge electrode segments $I_Y$ and the electrode portion $A_Y$ of the electrode elements Y by the respective electrode portions $A_Y$ when the respective electrode portions contact with the discharge electrode segments IY of the lower layer.

Incidentally, while the display device is of the AC driving type in the above-mentioned example, the display device may be arranged as the DC driving type. In this case, the dielectric layer 16 and the surface layer 17 are not formed. Then, in the case of this DC discharge, since the electrode on the cathode side is oxidized and the electrode on the anode side is reduced in general, the electrode elements comprising the first or second electrode group 11 or 12 which becomes the electrode on the anode side may be made of an oxide metal such as ITO, $SnO_2$, $In_2O_3$ or the like and the electrode elements comprising the second or first electrode group 12 or 11 which becomes the electrode on the cathode side may be made of a metal electrode such as Al, Cu, Ni, Fe, Cr, Zn, Au, Ag, Pb and so on or alloy of more than one kind of the above-mentioned metals.

Accordingly, in this case, it is not preferable that the first electrode group 11 and the second electrode group 12 are formed of the same conductive layer. In this case, in the respective electrode elements Y of the second electrode group 12, the electrode portion $A_Y$ and the discharge portion $I_Y$ thereof are made of the same conductive layer.

Also, in any case the display device is of the AC or DC driving type, if the electrode X of the first electrode group 11, for example, is made of an oxide electrode such as a transparent electrode or the like, then its specific resistance is generally large. Therefore, in this case, a conductive layer such as Al, Ni, Cu or the like having an excellent conductivity should preferably be deposited on one side edge extended along the band-shaped electrode element in the row direction.

According to the planar type plasma discharge display device with the arrangement described above of the present invention, the first and second electrode groups 11 and 12 which serve as the respective discharge electrodes are formed on the common substrate, in the above-mentioned example, the first substrate 1 comprising the flat receptacle. Alternatively, a substrate different from the substrate 1 may be used as a common substrate on which the first and second electrode groups 11 and 12 are formed, which may be disposed on the first substrate 1.

Also, while in the above-mentioned example, the first and second electrode groups 11 and 12 are formed on the common substrate, as in the ordinary planar type plasma discharge display device, the first and second electrode groups 11 and 12 may be formed on the first and second substrates 1 and 2 which are opposed to each other. However, in this case, the dielectric layer is formed on one electrode group and the fluorescent layer is formed on this dielectric layer. In this case, in order to avoid the fluorescent layer from being damaged by plasma, the fluorescent material is avoided from being coated on the discharge electrode segment disposed under the fluorescent layer, and the fluorescent material is coated on the side surface of the partition 18 and the nearby portion thereof. As a result, the light-emission area of the fluorescent material is decreased, and hence a brightness is lowered. Further, since an accuracy for setting a positional relationship between the first and second electrode groups is determined depending upon an alignment accuracy of the first and second substrates, a work efficiency is lowered, a sufficiently-high accuracy is difficult to be obtained, and characteristics of products tend to be fluctuated. Further, when a color image is displayed, since one electrode pattern should be formed on the same plate and the fluorescent patterns of respective colors should be coated on the above-mentioned same plate with a care so that the mutual positional relationship and the previously-formed fluorescent pattern or the electrode pattern may not be hindered, a work efficiency is lowered.

Conversely, when the first and second electrode groups 11 and 12 are formed on the common substrate as in the above-mentioned respective examples, the above-mentioned problems may be avoided, a brightness may be increased, a work efficiency in the manufacturing and assembly may be improved, accordingly, a mass-producibility is improved, a display device with uniform characteristics may be manufactured, which leads to the increase of yield and the reduction of cost.

As described above, according to the arrangement of the present invention, since every other terminals led out from the electrode elements Y of the second electrode group 12 are connected, it is possible to reduce the number of terminals for scanning this direction, e.g. horizontal direction by half. Then, with respect to the first electrode group, the plasma discharge portion is not formed between the electrode elements of the second electrode group with respect to the respective electrode elements unlike the ordinary matrix type but the plasma discharge portion is formed between every other electrode elements of the second electrode group. Therefore, when pixels of the number in the ordinary matrix type are formed, with respect to the electrode elements of the first electrode group, the electrode elements of the number twice the number of the electrode elements in the ordinary matrix type are required. In addition, since the terminals are respectively led out from these electrode elements, the number of the terminals doubles. In other words, the numbers of led-out terminals with respect to the first and second directions become close to each other. However, as mentioned in the beginning, since the number of the pixels in the vertical direction and the number of the pixels in the horizontal direction are generally different from each other considerably, although the number of the terminals led out to the horizontal direction doubles, the disadvantages caused with the increase of the terminals will not become serious in actual practice.

Also, as described above, it was confirmed that, when the first and second electrode groups which form a pair of discharge electrode groups in a two-dimensional fashion are disposed on the common substrate, plasma discharge for displaying an image may be reliably be produced by selecting the layout of the electrodes, the applied voltage or the like.

Then, when the first and second electrode groups are disposed on the common substrate as described above, there arises a problem that the terminals led out concerning the aforementioned horizontal scanning will become dense. According to the arrangement of the present invention, however, it is possible to solve the problem of the led-out terminals.

While the terminals of the first and second electrode groups are led out from left and right and upper and lower side edges of the substrates 1 and 2 in the above-mentioned illustrated example, the terminals may be led out from any one of the two substrates.

As described above, according to the arrangement of the present invention, since every other terminals are led out from the electrode elements Y of the second electrode group 12 and then connected, the number of the terminals for effecting the scanning of this direction, e.g. horizontal direction may be reduced by half. Therefore, unlike the ordinary matrix type in which the led-out terminals are dense because the number of terminals concerning the horizontal scanning is considerably larger than the number of terminals concerning the vertical scanning, it is possible to improve the hindrance on miniaturizing the display device and also to improve a reliability of display device or the like.

Having described preferred embodiments of the present invention with reference to the accompanying drawings, it is to be understood that the present invention is not limited to the above-mentioned embodiments and that various changes and modifications can be effected therein by one skilled in the art without departing from the spirit or scope of the present invention as defined in the appended claims.

What is claimed is:

1. A planar type plasma discharge display device, which comprises:

a first electrode group, composed of a first plurality of electrode elements and a second electrode group composed of a second plurality of electrode elements, arrayed on a common substrate in a two-dimensional fashion, and a desired image displayed by plasma discharge produced between predetermined electrode elements of said first and second electrode groups.

2. A planar type plasma discharge display device, which comprises:

a first electrode group composed of a plurality of electrode elements and a second electrode group composed of a plurality of electrode elements, arrayed on a common substrate in a two-dimensional fashion, the electrode elements of said first electrode group being composed of a plurality of electrode elements extended along a first direction and arrayed with a predetermined interval in parallel to each other, the electrode elements of said second electrode groups being composed of electrode elements extended along a second direction crossing said first direction and arrayed with a predetermined interval in parallel to each other, wherein insulating layers are interposed at portions in which the electrode elements of said first and second electrode groups cross each other, a first discharge electrode segment is formed on at least a first electrode element of said first or second electrode group, and a plasma discharge segment is formed between said first discharge electrode segment and a second discharge electrode segment formed on a second electrode element of said first or second electrode group.

3. A planar type plasma discharge display device as claimed in claim 2, wherein any electrode element of said first electrode group and any of said discharge electrode segments of the electrode element of said second electrode group are made of the same conductive layer.

4. A planar type plasma discharge display device as claimed in claim 1, wherein first and second substrates are opposed with a predetermined interval, said first and second substrates are sealed airtight at their peripheral portions to form a planar type display receptacle, at least one of said first and second substrates is formed of a transparent substrate for passing display light therethrough, and said first substrate is said common substrate on which said first and second electrode groups are formed.

5. A planar type plasma discharge display device as claimed in claim 2, wherein first and second substrates are opposed with a predetermined interval, said first and second substrates are sealed airtight at their peripheral portions to form a planar type display receptacle, at least one of said first and second substrates is formed of a transparent substrate for passing display light therethrough, and said first substrate is said common substrate on which said first and second electrode groups are formed.

6. A planar plasma discharge display device as claimed in claim 1, wherein first and second substrates are opposed with a predetermined interval, said first and second substrates are sealed airtight at their peripheral portions to form a planar type display receptacle, at least one of said first and second substrates is formed of a transparent substrate for passing display light therethrough, said first substrate is said common substrate on which said first and second electrode groups are formed, and a fluorescent layer is formed on said second substrate.

7. A planar type plasma discharge display device as claimed in claim 2, wherein first and second substrates are opposed with a predetermined interval, said first and second substrates are sealed airtight at their peripheral portions to form a planar type display receptacle, at least one of said first and second substrates is formed of a transparent substrate for passing display light therethrough, said first substrate is said common substrate on which said first and second electrode groups are formed, and a fluorescent layer is formed on said second substrate.

8. A planar type plasma discharge display device as claimed in claim 1, wherein first and second substrates are opposed with a predetermined interval, said first and second substrates are sealed airtight at their peripheral portions to form a planar type display receptacle, at least one of said first and second substrates is formed of a transparent substrate for passing display light therethrough, said first substrate is said common substrate on which said first and second electrode groups are formed, and a partition for partitioning a unit discharge region is formed on said second substrate.

9. A planar type plasma discharge display device as claimed in claim 2, wherein first and second substrates are opposed with a predetermined interval, said first and second substrates are sealed airtight at their peripheral portions to form a planar type display receptacle, at least one of said first and second substrates is formed of a transparent substrate for passing display light therethrough, said first substrate is said common substrate on which said first and second electrode groups are formed, and which said first and second electrode groups are formed, and a partition for partitioning a unit discharge region is formed on said second substrate.

10. A planar type plasma discharge display device as claimed in claim 1, wherein a dielectric layer is formed over portions in which said first and second electrode groups are formed.

11. A planar type plasma discharge display device as claimed in claim 2, wherein a dielectric layer is formed over portions in which said first and second electrode groups are formed.

12. A planar type plasma discharge display device as claimed in claim 10, wherein said dielectric layer has formed thereon a surface layer whose work function is smaller than that of said dielectric layer.

13. A planar type plasma discharge display device as claimed in claim 11, wherein said dielectric layer has formed thereon a surface layer whose work function is smaller than that of said dielectric layer.

14. A method of manufacturing a planar type plasma discharge display device, which comprises the steps of:

forming a first electrode group by arraying a plurality of electrode elements extended in a first direction, forming a second electrode group by arraying a plurality of electrode elements extended in a direction crossing said first direction, said electrode elements of said second electrode group comprising sets of four adjacent electrode elements wherein a common terminal is led out from every other electrode element in each set; and forming a plasma discharge portion in response to a portion in which every other electrode element of said first electrode group and corresponding two adjacent electrode elements in each set of said second electrode group cross each other.

15. A method as claimed in claim 14, wherein said first electrode group and said second electrode group are disposed on a common substrate in a two-dimensional fashion.

16. A method as claimed in claim 15, wherein electrode elements of any of said first electrode group and said second electrode group comprise a discharge electrode portion disposed on said plasma discharge portion and an electrode portion extended in said first direction and a second direction.

17. A method as claimed in claim 15, wherein a first substrate and a second substrate are opposed with a predetermined interval, said first and second substrates are sealed airtight at their peripheral portions to form a planar type display receptacle, at least any one of said first and second substrates is formed of a transparent substrate for passing display light, and said first substrate is used as said common substrate on which said first and second electrode groups are formed.

18. A method as claimed in claim 17, wherein said second substrate has a fluorescent layer formed thereon.

19. A planar type plasma discharge display device as claimed in claim 17, wherein said second substrate has formed thereon a partition for partitioning a unit discharge region.

20. A method as claimed in claim 14, wherein a dielectric layer is formed over portions in which said first and second electrode groups are formed.

21. A method as claimed in claim 15, wherein a dielectric layer is formed over portions in which said first and second electrode groups are formed.

22. A method as claimed in claim 20, wherein said dielectric layer has formed thereon a surface layer whose work function is smaller than that of said dielectric layer.

23. A method as claimed in claim 21, wherein said dielectric layer has formed thereon a surface layer whose work function is smaller than that of said dielectric layer.

* * * * *

UNITED STATES PATENT AND TRADEMARK OFFICE

CERTIFICATE OF CORRECTION

PATENT NO. : 6,329,749 B1
DATED : December 11, 2001
INVENTOR(S) : Hiroshi Mori and Suehiro Nakamura It is certified that error appears in the above-identified patent and that said Letters Patent is hereby corrected as shown below:

Column 28,
Lines 52-54, delete "and which said first and second electrode groups are formed,".

Signed and Sealed this

Thirtieth Day of April, 2002

*Attest:*

*Attesting Officer*

JAMES E. ROGAN
*Director of the United States Patent and Trademark Office*